US006443765B2

(12) United States Patent
Ichio et al.

(10) Patent No.: US 6,443,765 B2
(45) Date of Patent: Sep. 3, 2002

(54) WATERPROOF CONNECTOR WITH SEALING MEMBER

(75) Inventors: Toshifumi Ichio; Kouji Nemoto; Shiro Nishida, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/963,724

(22) Filed: Sep. 26, 2001

Related U.S. Application Data

(62) Division of application No. 09/521,553, filed on Mar. 9, 2000, now Pat. No. 6,302,734.

(30) Foreign Application Priority Data

Mar. 9, 1999 (JP) ..... 11-061856
Mar. 17, 1999 (JP) ..... 11-136172

(51) Int. Cl.[7] ..... H01R 13/40
(52) U.S. Cl. ..... 439/587; 439/274; 439/459
(58) Field of Search ..... 439/271–276, 439/219, 456, 459, 548, 587, 589, 604

(56) References Cited

U.S. PATENT DOCUMENTS 5,145,402 A * 9/1992 Plyler et al. ..... 439/274
5,890,927 A * 4/1999 Yashima ..... 439/587
5,928,033 A * 7/1999 Kato et al. ..... 174/77 R
5,980,316 A * 11/1999 Shinchi ..... 439/587
6,217,385 B1 * 4/2001 Genta et al. ..... 439/587
6,302,734 B1 * 10/2001 Ichio et al. ..... 439/274

* cited by examiner

*Primary Examiner*—Gary F. Paumen
*Assistant Examiner*—James R. Harvey
(74) *Attorney, Agent, or Firm*—Gerald E. Hespos; Anthony J. Casella

(57) ABSTRACT

A connector is provided with a short longitudinal direction. The connector includes a housing (11) with a cavity (13). an electric wire (45) extends to a position rearwardly of the cavity (13), and is bent downwardly. A cover (30) then is pressed against the housing (11), with the electric wire (45) sandwiched between sealing members (50), (51) made of a jelly-like material. As a result, the sealing member (51) penetrates into the gap between confronting portions on of the housing (11) and the cover (30). The sealing members (50), (51) also are pressed against both sides of the electric wire (45). As a result, the periphery of the electric wire (45) is filled with the cover-side sealing members (50), (51).

6 Claims, 26 Drawing Sheets

WATERPROOF CONNECTOR WITH SEALING MEMBER

This application is a divisional of U.S. patent application Ser. No. 09/521,553 filed on Mar. 9, 2000, now U.S. Pat. No. 6,302,734.

BACKGROUND OF THE INVENTION

1. Field of the Invention

The present invention relates to a waterproof connector.

2. Description of the Related Art

A known waterproof connector is identified by the numeral 1 in FIGS. 44 and 45. The prior art connector 1 has a terminal fixture 3 connected with an electric wire 2. The connector 1 further has a housing 5 with a cavity 4 dimensioned for accommodating the terminal fixture 3. An insulation barrel 3A is provided at a rear end portion of the terminal fixture 3 to fixedly crimp a rubber plug 7 into which the electric wire 2 has been inserted. The rubber plug 7 is in close contact with an inner peripheral wall of the cavity 4 and with the electric wire 2 to waterproof each cavity 4.

A cover 6 is installed on a rear end portion of the housing 5 and enables a bending of the electric wire 2. The cover 6 of the prior art connector 1 is constructed of a pair of half covers 6A and 6B which are butted to each other. An electric wire lead-out opening 8 is formed on an end surface of each of the half covers 6A and 6B . Thus, the electric wire 2 can be drawn out to the outside through the electric wire lead-out opening 8 when both half covers 6A and 6B are bought into contact with each other.

The prior art connector 1 has a length A in its longitudinal direction, as shown in FIG. 45. The length A is required to be as small as possible because of a limited space. However, the electric wire 2 is sealed with the rubber plug 7, and hence the housing 5 should be long enough to incorporate the rubber plug 7 therein. Thus, the construction of the prior art connector 1 prevents the length A from being reduced.

SUMMARY OF THE INVENTION

The present invention has been made in view of the above-described situation, and it is an object of the present invention to provide a connector that is short in its longitudinal direction.

The subject invention is directed to a connector. The connector comprises a terminal fixture with opposite first and second ends. The first end of the terminal fixture can be connected with a mating terminal fixture, and the second end can be connected with one end of an electric wire.

The connector also comprises a housing having opposite front and rear sides. At least one cavity extends through the housing from the front side thereof to the rear side. The cavity is dimensioned to accommodate the terminal fixture.

A cover is installed on the housing to cover an electric wire draw-out portion at the rear side of the housing. The cover functions to lead the electric wire that is drawn out from the cavity to the outside through the electric wire lead-out opening, such that the electric wire is bent sideways.

The connector further comprises a sealing member for sealing a gap between the cover and the housing and for sealing a periphery of the electric wire at the electric wire lead-out opening.

In accordance with the invention, it is unnecessary to provide the housing with a sealing portion for sealing the gap between the inner peripheral wall of the cavity and an electric wire. Thus, it is possible to reduce the size of the connector in its longitudinal direction.

A housing-side opening edge portion is formed on the housing and a cover-side opening edge portion is formed on the cover. The housing-side opening edge portion and the cover-side opening edge portion form the electric wire lead-out opening when the cover is installed on the housing. The electric wire is capable of penetrating radially into an inner side of the housing-side opening edge portion and the cover-side opening edge portion. Accordingly, it is easy to insert the electric wire into the electric wire lead-out opening.

The sealing member may be made of a gel or jelly-like material and may be pressed and deformed during installation of the cover on the housing. Thus the sealing member seals the gap between the cover and the housing and further seals the periphery of the electric wire at the electric wire lead-out opening. Waterproofing therefore can be accomplished merely by installing the cover.

The sealing member has a housing-side sealing member that is installed on the housing and a cover-side sealing member that is installed on the cover. Consequently, the sealing member seals the periphery of the electric wire at the electric wire lead-out opening by sandwiching the electric wire between the housing-side sealing member and the cover-side sealing member during the installation of the cover on the housing. The embodiment described above enables the jelly-like sealing material to contact the electric wire both from the housing side and from the cover side. Thus waterproofing can be accomplished securely.

The sealing member may comprise an electric wire-sealing portion that seals a periphery of the electric wire lead-out opening. The electric wire-sealing portion may be in close contact with the periphery of the electric wire and may be formed of a sealing portion that is integral with the electric wire-sealing portion. The sealing portion seals a gap between a housing-side confronting portion of the housing and a cover-side confronting portion of the cover. Thus the sealing portion may be sandwiched elastically between the housing-side confronting portion and the cover-side confronting portion. This aspect of the invention enables a small number of parts to be used. As a result, assembly work can be accomplished easily.

The electric wire-sealing portion has a cylindrical portion with a nick formed radially thereon. The nick is disposed and dimensioned to receive the electric wire. A pair of guide projections may be formed at both side edges of the nick. The guide projections elastically diverge outwardly from the cylindrical portion of the nick to guide the electric wire into the cylindrical portion. The cover has a press-in piece that penetrates into an outer side of each of the guide projections to deform the guide projections in a closing direction, and to seal the periphery of the electric wire when the cover is installed on the housing. The electric wire may be inserted through the nick in accordance with this embodiment. Thus the electric wire can be installed smoothly on the electric wire-sealing portion.

A plurality of insertion holes extend through the electric wire sealing portion. The insertion holes are dimensioned for watertight engagement with electric wires that can be penetrated through the insertion holes. The electric wire-sealing portion is divided on a surface crossing the respective insertion holes. The divided electric wire-sealing portions are held in a connected state by installing the cover on the housing. Thus the sealing member can be installed after the terminal fixture is installed in the cavity, and superior workability is achieved.

The cover may have a pressing portion for pressing the divided electric wire-sealing portions in a closed state. Thus both electric wire-sealing portions can be closed firmly by the installation of the cover on the housing. As a result, it is possible to obtain a high degree of sealing performance in the periphery of the electric wire.

The divided electric wire-sealing portions may be connected with each other by a hinge such that the divided electric wire-sealing portions can be opened and closed. Consequently, the electric wire-sealing portion can be handled as a single sealing member that is easy to handle.

The housing may have a temporary holding means for temporarily holding the sealing member, with the divided electric wire-sealing portions connected with each other. Thus it is possible to temporarily hold the sealing member before the cover is installed on the housing, and installation of the cover on the housing is facilitated.

DETAILED DESCRIPTION OF THE PREFERRED EMBODIMENTS

Figure 1:
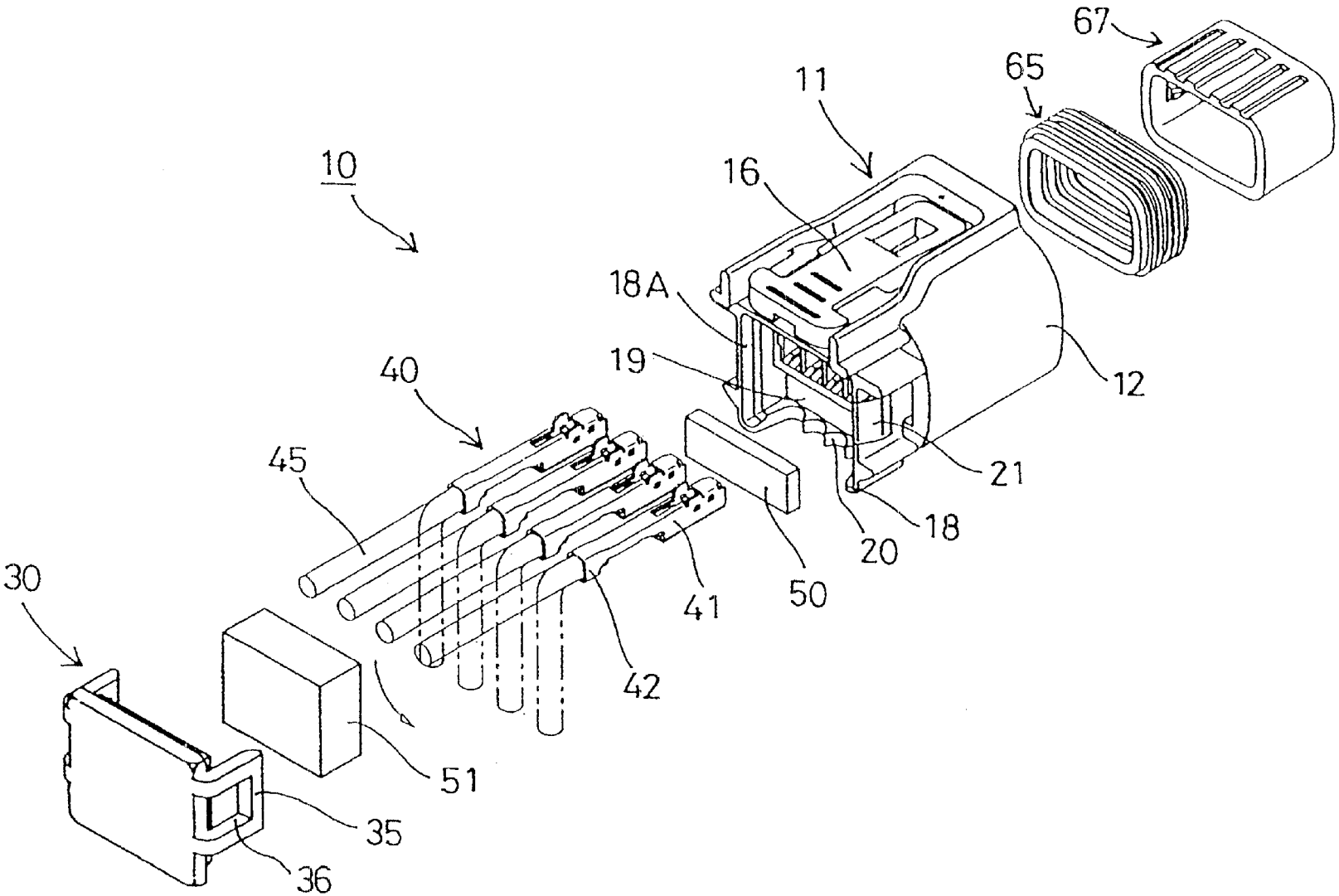
FIG. 1 is an exploded perspective view showing a connector of a first embodiment of the present invention.
Figure 2:
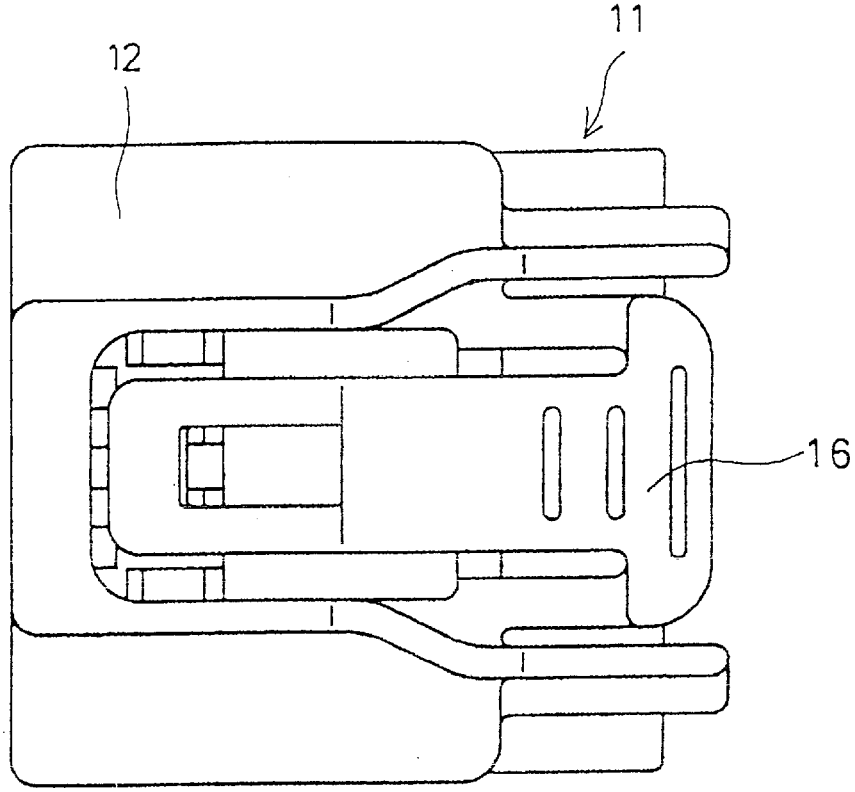
FIG. 2 is a plan view showing a housing.
Figure 3:
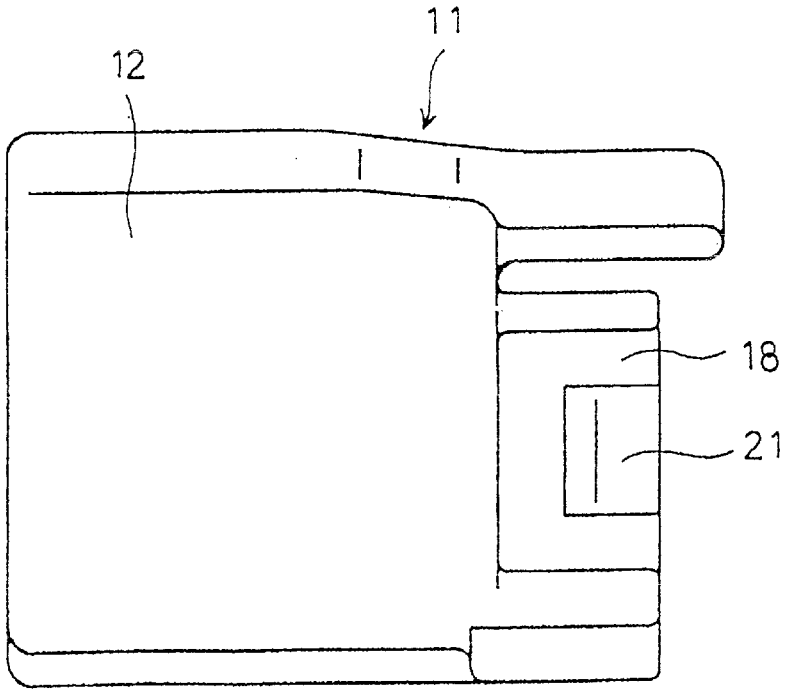
FIG. 3 is a side view showing the housing.
Figure 4:
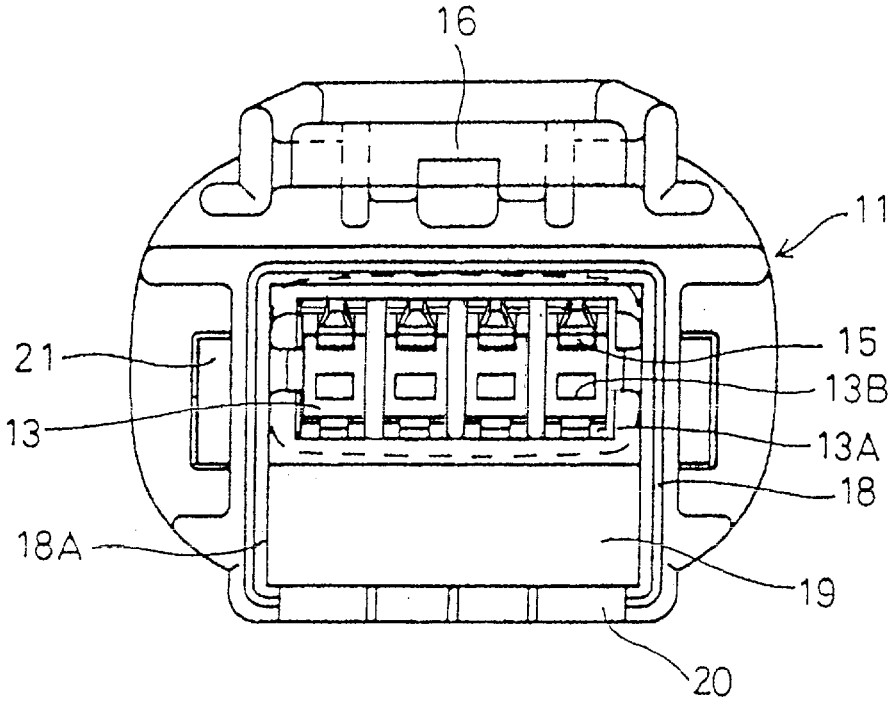
FIG. 4 is a rear view showing the housing.

A first embodiment of the present invention will be described below with reference to FIGS. 1–17.

A connector 10 in accordance with a first embodiment of the subject invention has a housing 11 with opposite front and rear sides, and a generally rounded or pillar shape at external locations extending between the front and rear sides. A hood part 12 is open at the front side of the housing 11 , and a plurality of cavities 13 extend from the rear side of the housing 11 to the open hood 12 at the front side of the housing 11. A plurality of female-side terminal fixtures 40 can be inserted into the cavities 13 from the rear, and a cover 30 is installed over the rear side of the housing 11 to cover the cavities 13 and the female-side terminal fixtures 40 inserted therein. A male-side connector 60 (shown with two-dot chain line in FIG. 15) can be inserted into the hood part 12. A locking arm 16 is provided on an upper surface of the housing 11, and is deform able generally with the motion of a seesaw. The locking arm 16 is configured to engage a part of the male-side connector 60, for holding the male-side connector 60 in an unremovable state within the hood 12.

Figure 5:
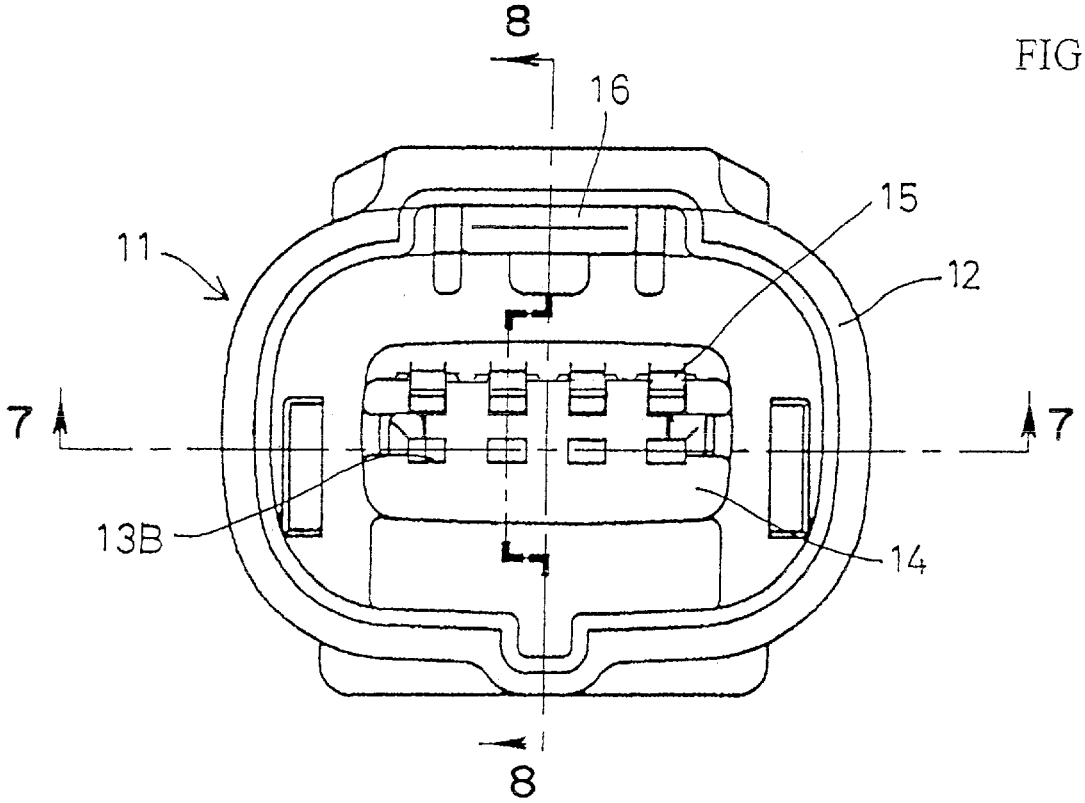
FIG. 5 is a front view showing the housing.
Figure 6:
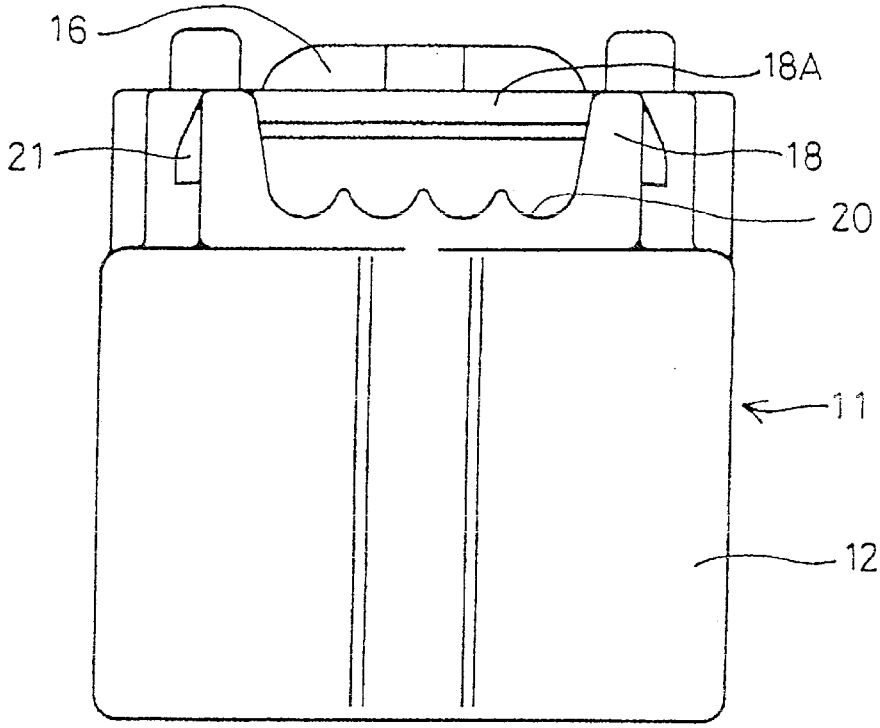
FIG. 6 is a bottom view showing the housing.
Figure 7:
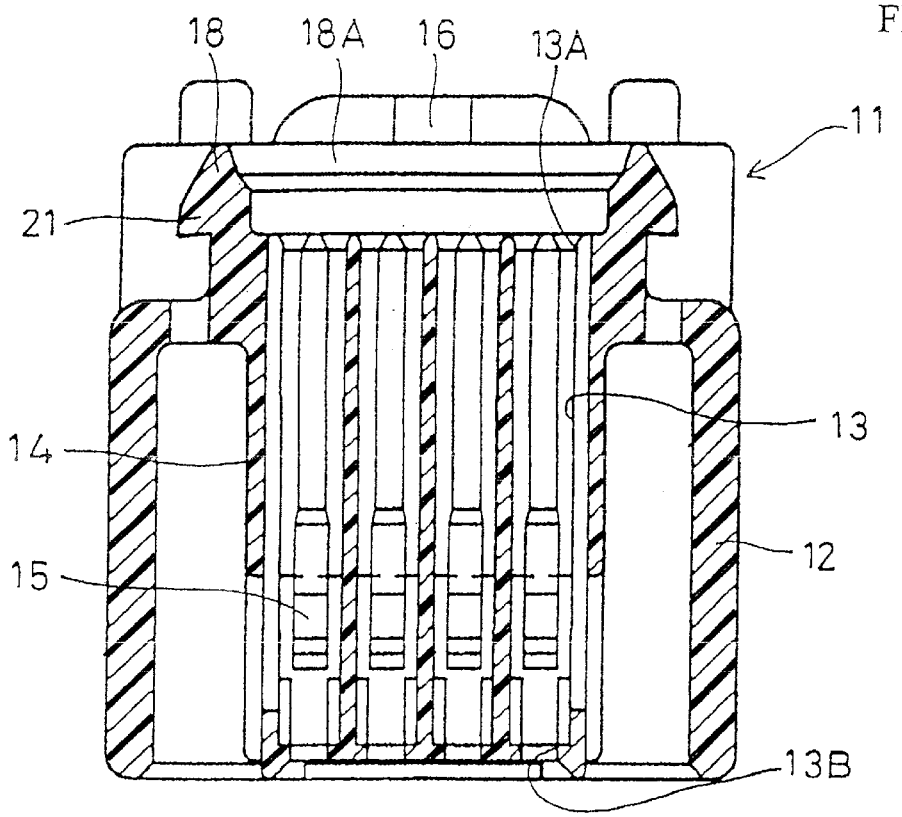
FIG. 7 is a sectional bottom view showing the housing.
Figure 8:
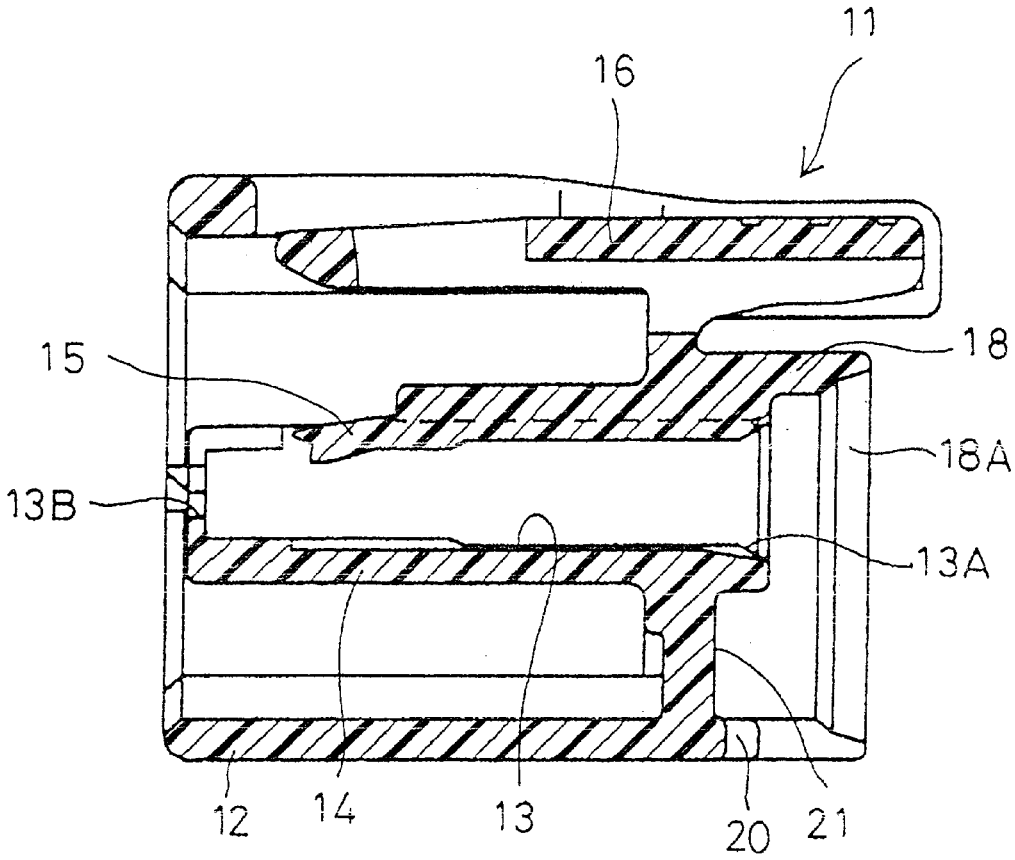
FIG. 8 is a sectional side view showing the housing.
Figure 9:
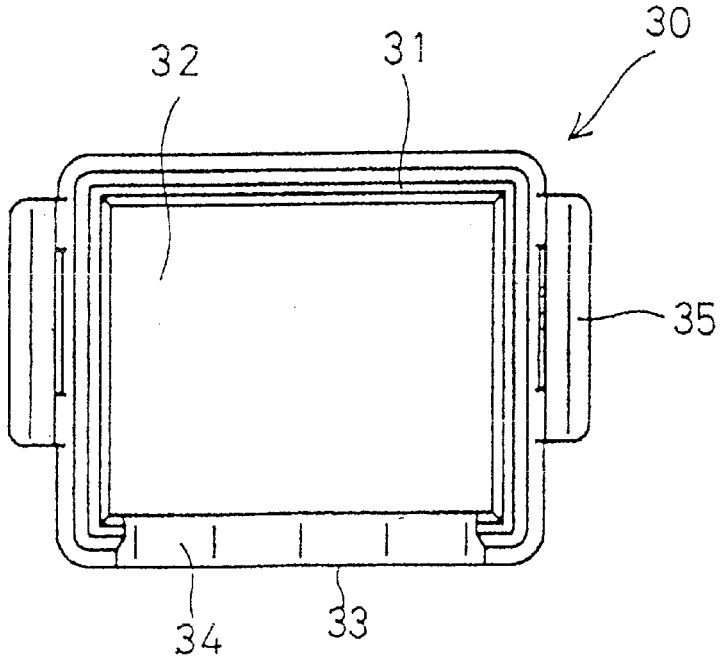
FIG. 9 is a front view showing a cover.
Figure 10:
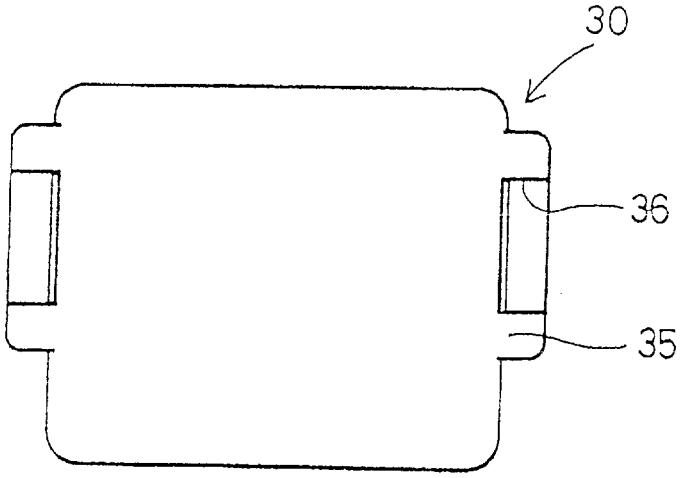
FIG. 10 is a rear view showing the cover.
Figure 11:
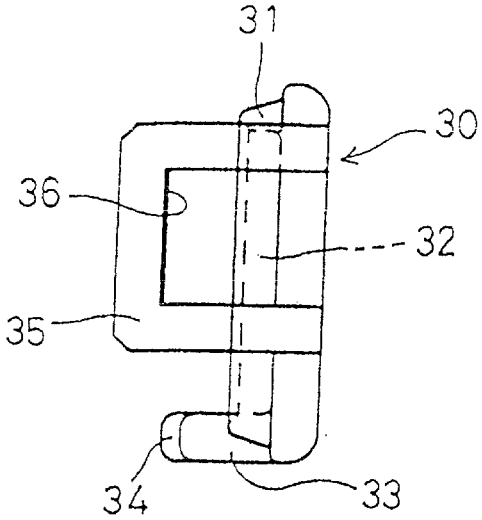
FIG. 11 is a side view showing the cover.
Figure 12:
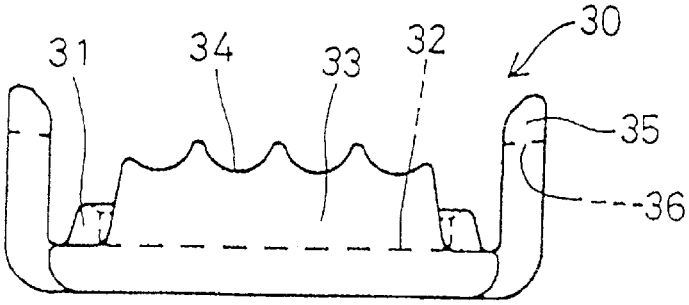
FIG. 12 is a bottom view showing the cover.

The cavities 13 are arranged across the width of the housing 11, and each cavity 13 has a length approximately equal to the length of the female-side terminal fixture 40 which will be accommodated therein. A peripheral wall of each cavity 13 projects into the hood 12 to define a projecting portion 14, as shown in FIGS 5, 7 and 8. Each cavity 13 has openings formed at its rear and front portions. The opening at the rear portion of each cavity 13 is a terminal insertion opening 13A into which the female-side terminal fixture 40 can be inserted. The opening at the front portion of each cavity 13 is a tab insertion opening 13B for receiving a tab (not shown) that projects from the male-side connector 60. A deformable lance 15 projects vertically from a position near the front end of an upper wall of the cavity 13. The lance 15 elastically engages the female-side terminal fixture 40, and prevents the female-side terminal fixture 40 from being removed from the cavity 13.

Figure 15:
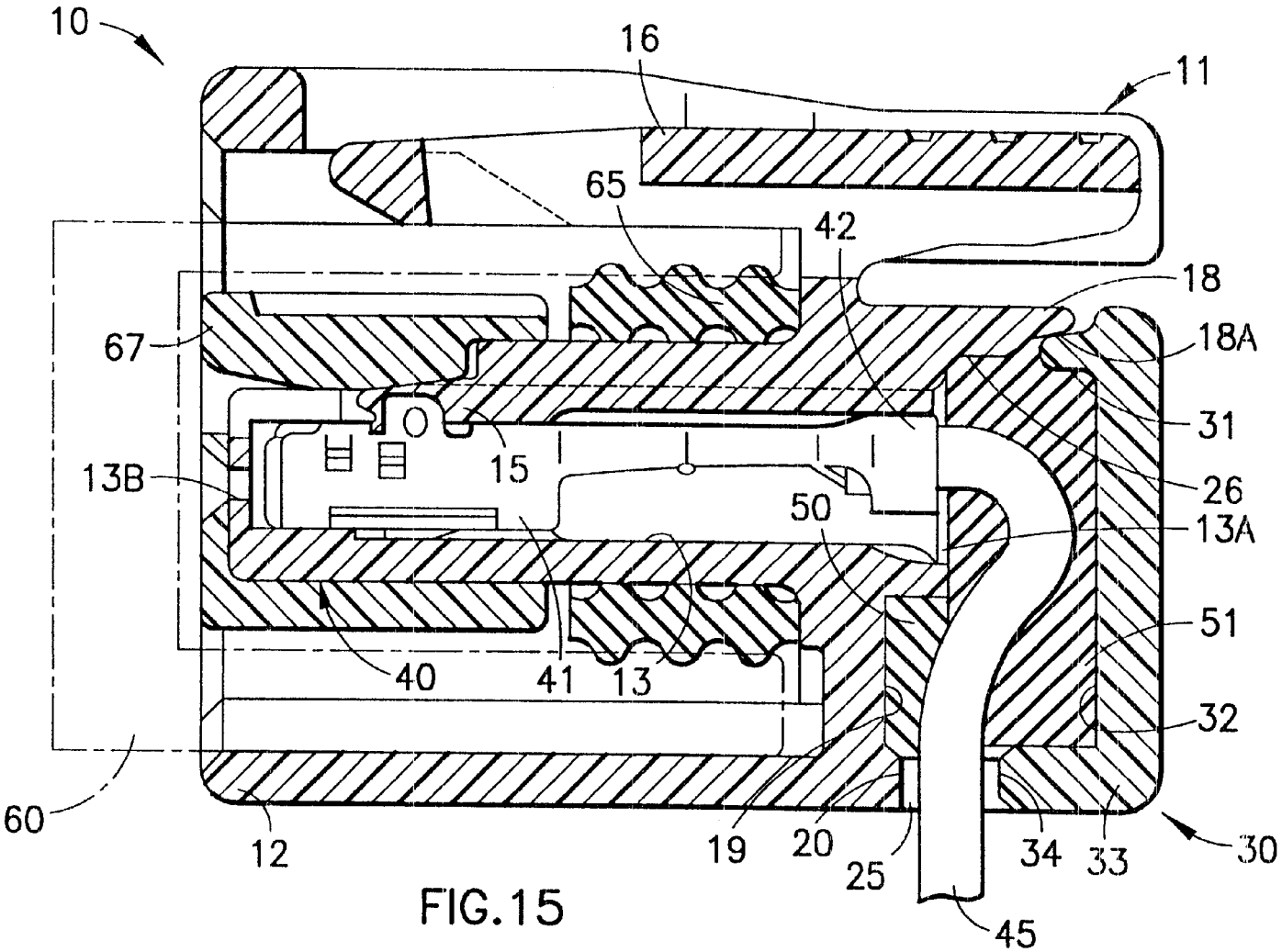
FIG. 15 is a sectional side view showing an assembled connector.
Figure 16:
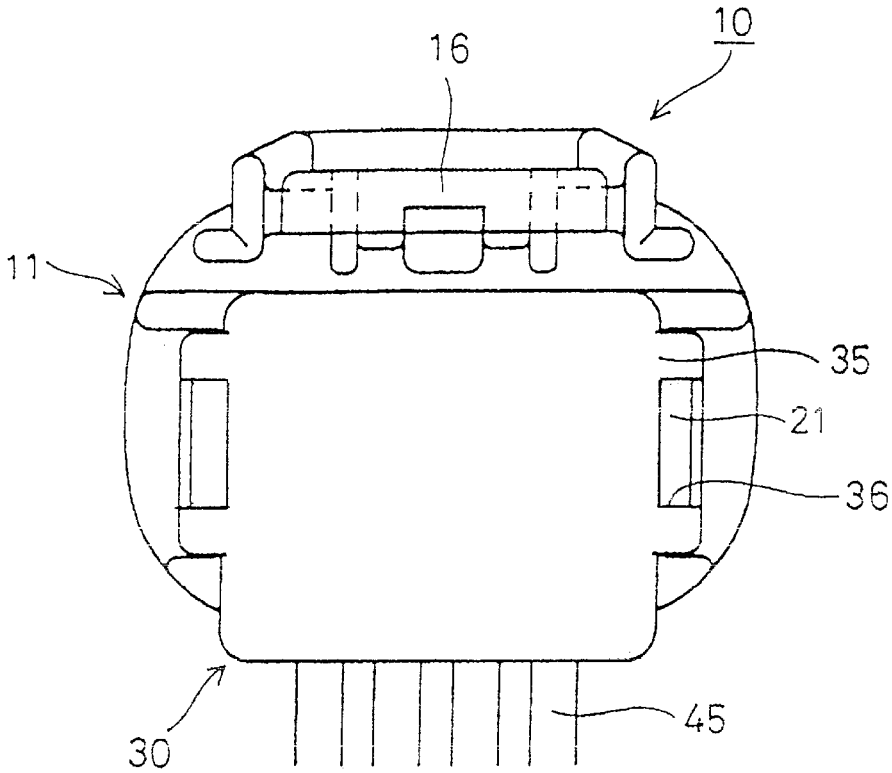
FIG. 16 is a rear view showing the assembled connector.

A rubber ring 65 can be mounted on a peripheral surface of the rear side of the projecting portion 14. The rubber ring 65 has several convexities on its inner and outer peripheral surfaces. The convexities closely contact the housing 11 and the male-side connector 60 to seal the gap therebetween, as shown in FIG. 15. A cylindrical retainer 67 is provided on the peripheral surface of the front side of the projecting portion 14, and has an engaging means that engages the projecting portion 14. The retainer 67 prevents deflection of the lance 15, and thus irremovably holds the female-side terminal fixture 40 in the cavity 13.

A housing-side confronting portion 18 is formed on the rear portion of the housing 11, and projects in the shape of a pillar. A rear opening 18A of the housing-side confronting portion 18 can be covered with the cover 30. A wire-bending space 26 is formed within the area bounded by the housing-side confronting portion 18 to accommodate the electric wires 45 which are bent downwardly from the terminal insertion openings 13A, as shown in FIG. 15. A concave portion 19 is formed below the terminal insertion openings 13A, and is configured to accommodate a housing-side sealing member 50 that will be described later.

The bottom surface of the housing-side confronting portion 18 is cut out from its rear end. Approximately semi-circular concave housing-side opening edge portions 20 are formed on the bottom surface of the concave portion 19 at locations aligned with the respective cavities 13. A pair of locking projections 21 are formed outwardly on each of left and right side surfaces of the housing-side confronting portion 18 for installing the cover on the housing 11.

Figure 17:
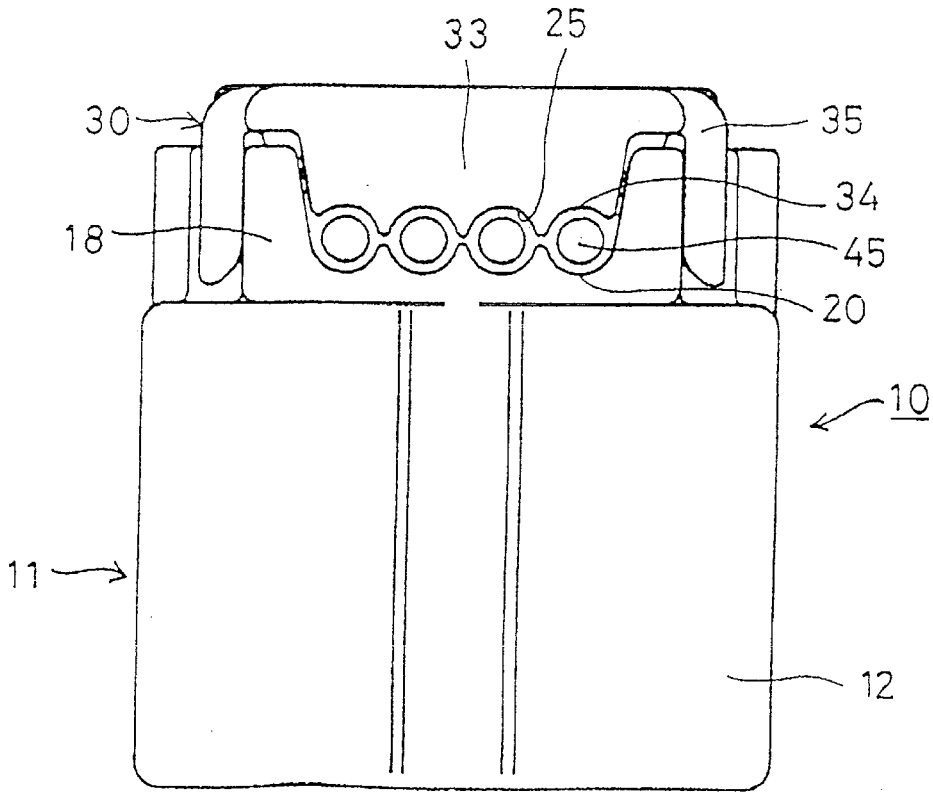
FIG. 17 is a bottom view showing the assembled connector.
Figure 18:
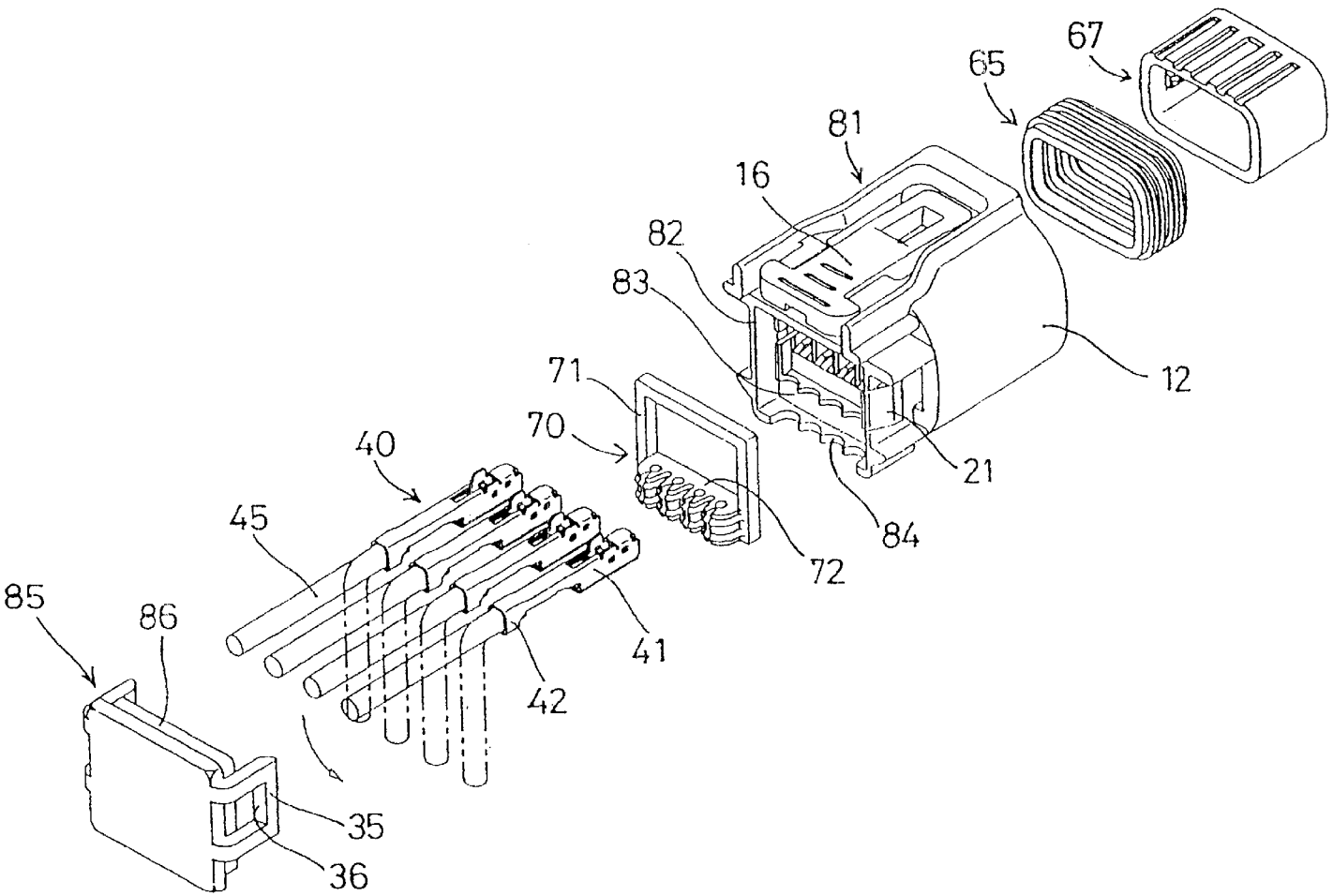
FIG. 18 is an exploded perspective view showing a connector of a second embodiment of the present invention.
Figure 19:
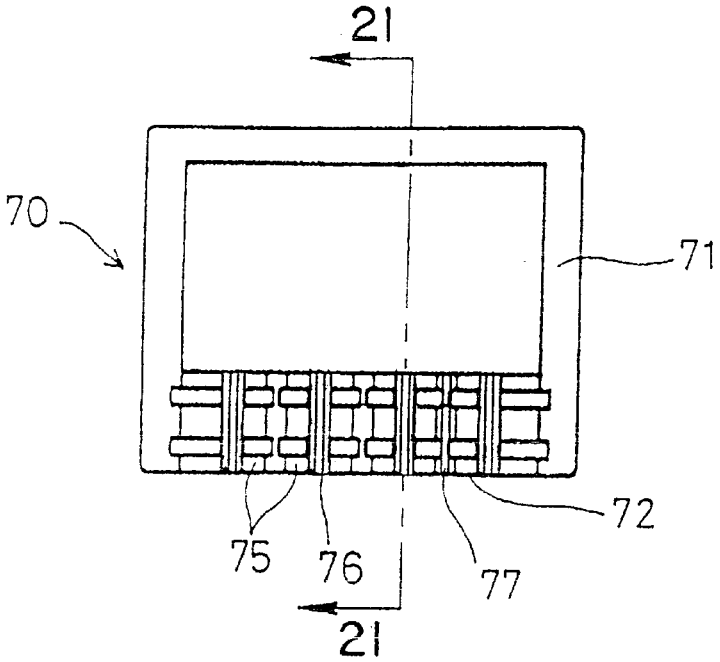
FIG. 19 is a rear view showing a sealing member.
Figure 20:
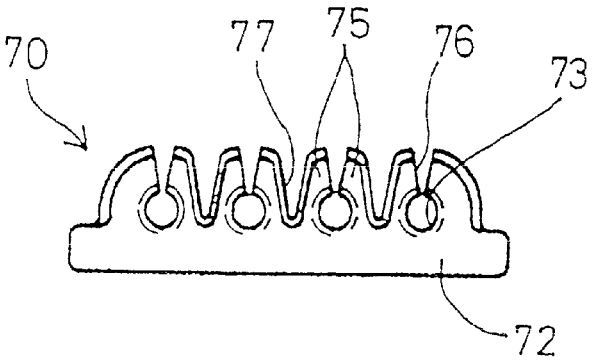
FIG. 20 is a bottom view showing the sealing member.
Figure 21:
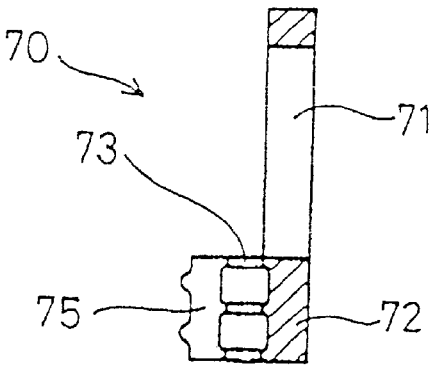
FIG. 21 is a sectional side view showing the sealing member.
Figure 22:
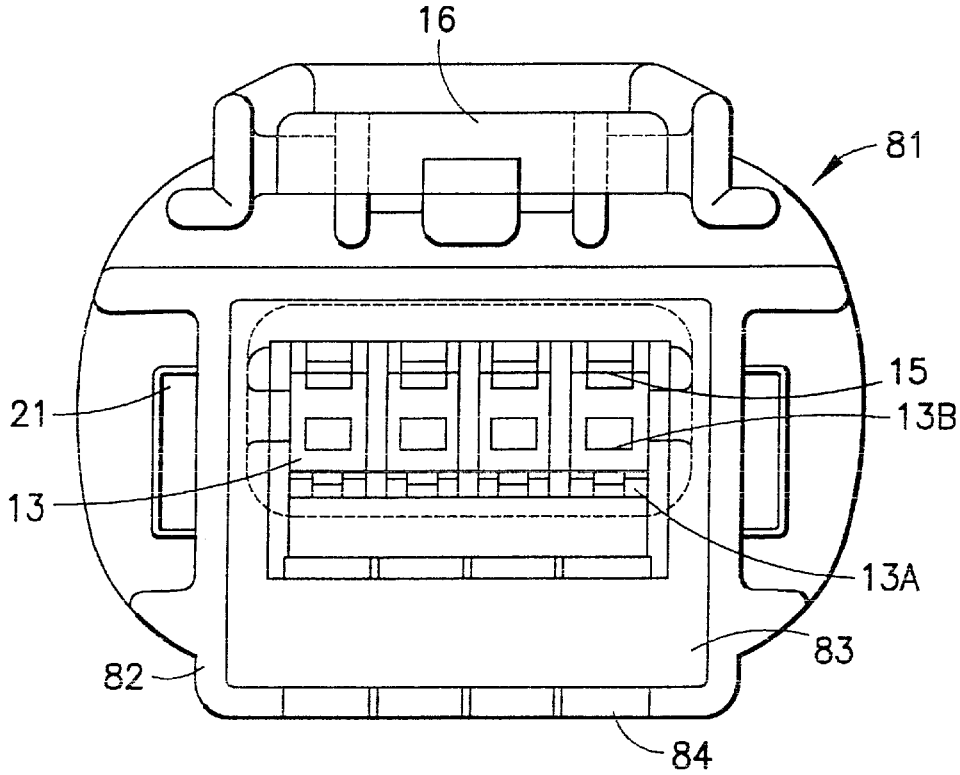
FIG. 22 is a rear view showing a housing.
Figure 23:
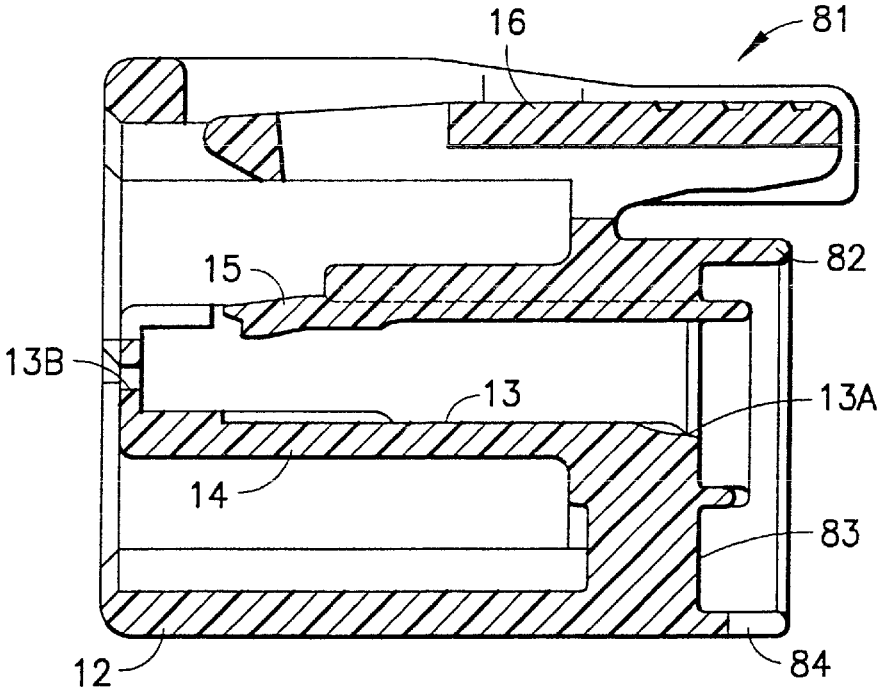
FIG. 23 is a sectional side view showing the housing.
Figure 24:
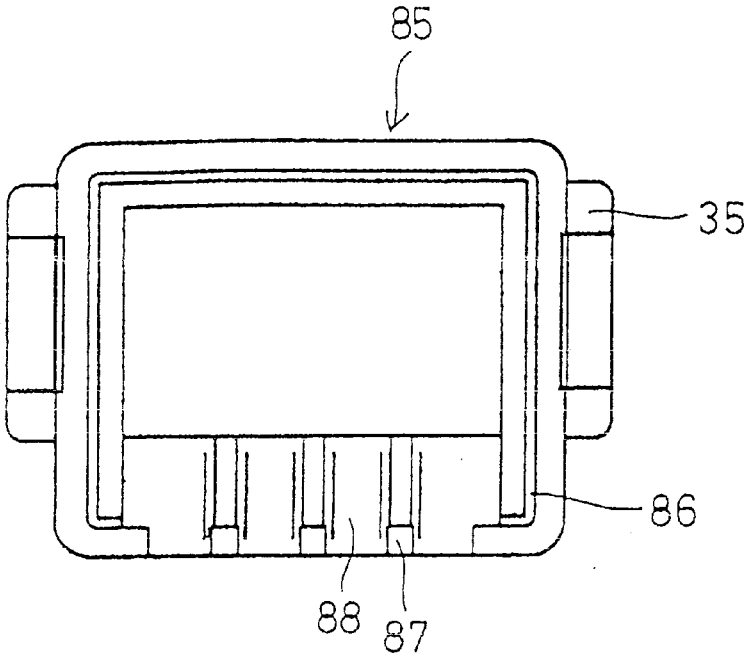
FIG. 24 is a front view showing a cover.
Figure 25:
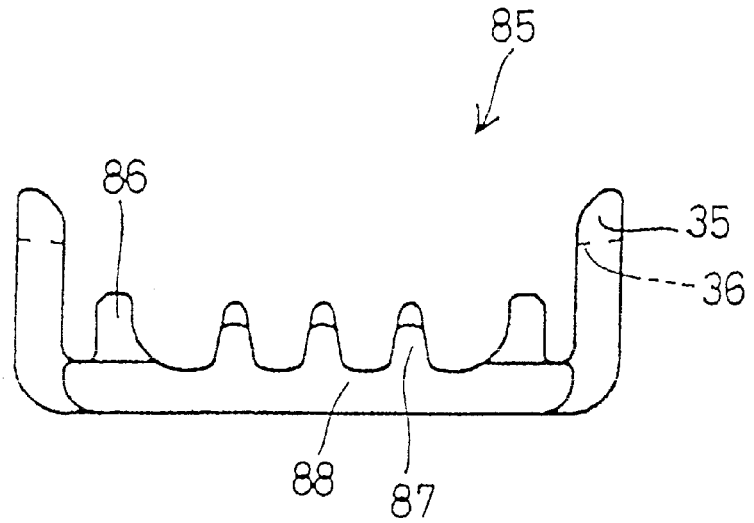
FIG. 25 is a bottom view showing the cover.

The flat plate-shaped cover 30 is made of a synthetic resinous material and is large enough to cover the rear opening 18A. A rectangular frame-shaped cover-side confronting portion 31 projects from the front surface of the cover 30. The cover-side confronting portion 31 fits on the inner side of the housing-side confronting portion 18 when the cover 30 is installed on the housing 11. A bottom wall portion 33 projects downwardly from the lower side of the cover-side confronting portion 31. Approximately semi-circular concave cover-side opening edge portions 34 are formed at the front end portion of the bottom wall portion 33 at locations that correspond to the housing-side opening edge portions 20. When the cover 30 is installed on the housing 11, the. bottom wall portion 33 matches the bottom surface of the housing-side confronting portion 18 to form a part of the bottom surface of the wire-binding space 26. At this time, both the housing-side opening edge portions 20 and the cover-side opening edge portions 34 form approximately circular electric wire lead-out openings 25. The electric wire 45 inside the wire-bending space 26 can be drawn to the outside through this wire lead-out opening as shown in FIG. 17. A concavity 32 is formed on the inner side of the cover-side confronting portion 31. The concavity 32 holds the cover-side sealing member 51 such that one end of the cover-side sealing member 51 fits in the concavity 32. The cover-side sealing member 51 will be described in detail below.

A pair of deformable locking arms 35 extend forwardly from left and right sides of the cover 30, and a rectangular locking hole 36 penetrates through each locking arm 35. The cover 30 is installed on the housing 11 by fitting the locking projections 21 of the housing 11 into the locking holes 36 of the cover 30.

The female-side terminal fixture 40 has a coupling portion 41 formed at its front. The coupling portion 41 can be engaged by the lance 15 when the female-side terminal fixture 40 is inserted into the cavity 13 of the housing 11. Additionally, the coupling portion 41 can be coupled to the tab of the male-side connector 60 A barrel portion 42 is formed at the rear of the female-side terminal fixture 40 for crimped connection to one end of the electric wire 45. The female-side terminal fixture 40 is dimensioned such that the rear edge of the barrel portion 42 aligns with the entry to the terminal insertion opening 13A when the female-side terminal fixture 40 is accommodated in the cavity 13. Thus, the electric wire 45 that is connected with the barrel portion 42 can be drawn out to the outside from the cavity 13 and bent immediately in the wire-bending space 26 at the rearward side of the housing 11.

The housing-side sealing member 50 and the cover-side sealing member 51 are made of a gel or jelly-like material. The housing-side sealing member 50 can be accommodated in the concavity 19 of the housing 11. The cover 30 holds the cover-side sealing member 51, with one end of the cover-side sealing member 51 pressed into the concavity 32 of the cover 30, and the other side of the cover-side sealing member 51 projecting toward the housing 11.

The connector 10 is assembled by providing female-side terminal fixtures 40 that have been crimped into connection with the respective electric wires 45. The female-side terminal fixtures 40 then are inserted into the respective cavities 13 from the terminal insertion opening 13A. The lance 15 in each cavity 13 engages the coupling portion 41 of the corresponding female-side terminal fixture 40 when the female-side terminal fixture 40 has been inserted to a predetermined position in the cavity 13. Thus the female-side terminal fixture 40 is prevented from being removed from the cavity 13.

The rubber ring 65 is mounted into the hood 12 and rearwardly over the projecting portion 14 at the front side of the housing 11. The retainer 67 then is installed in a front to rear direction onto the projecting portion 14 to prevent deflection of the lances 15 and thus further preventing removal of the female-side terminal fixtures 40 from the cavities 13.

Figure 13:
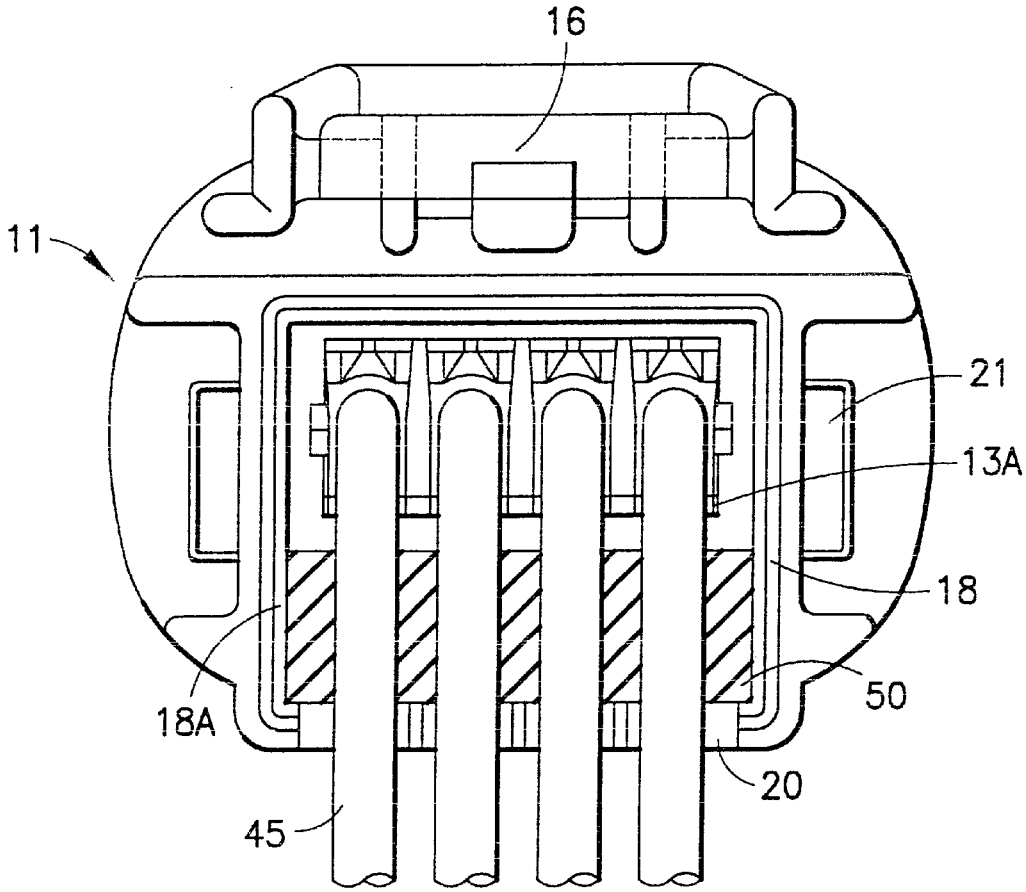
FIG. 13 is a rear view showing the process of installing parts on the housing.
Figure 14:
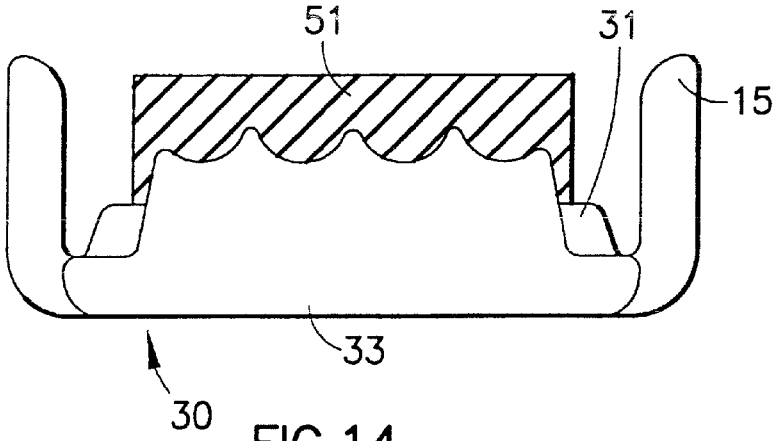
FIG. 14 is a bottom view showing a state in which a sealing member is installed on the cover.

Assembly of the connector 10 proceeds by installing the housing-side sealing member 50 into the concavity 19 at the rear side of the housing 11. The electric wire 45, that had been extended from the terminal insertion opening 13A, then is bent downwardly, as shown in FIG. 13. Assembly proceeds by pressing the cover-side sealing member 51 into the concavity 32 of the cover 30 so that the cover 30 holds the cover-side sealing member 51 in place, as shown in FIG. 14.

At this point in the assembly process, the bent electric wire 45 is sandwiched between the housing-side sealing member 50 and the cover-side sealing member 51. The cover 30 then is pressed against the housing 11. As a result, the electric wire 45 is pressed against the cover-side sealing member 51 and crushes the cover-side sealing member 51 in the vicinity of the terminal insertion opening 13A. The cover-side sealing member 51 then spreads into the wire-bending space 26 and penetrates tightly into the entire periphery of both confronting portions 18 and 31. The electric wire 45 penetrates radially into the opening edge portions 20, 34, and the housing-side sealing member 50 and the cover-side sealing member 51 are pressed against the e electric wire 45 from both sides. As a result, the gap between the respective electric wires 45 and both opening edge portions 20, 34 are filled with the housing-side sealing member 50 and the cover-side sealing member 51 along the entire circumference of the opening edge portions 20, 34. The locking projection portions 21 on the housing are fitted into the locking holes 36 when the cover 30 is pressed to the predetermined position. In this manner, the assembling of the connector 10 is completed.

As described above, the housing-side sealing member 50 and the cover-side sealing member 51 completely seal the gap between the housing-side confronting portion 18 of the housing 11, the cover-side confronting portion 31 of the cover 30 and the periphery of the electric wire 45 at the electric wire lead-out opening 25. Thus, unlike the conventional construction of the housing, the construction of this first embodiment eliminates the need for providing the cavity of the housing with a long sealing portion of a rubber plug or the like. Consequently, the construction allows the connector to be short in its longitudinal direction.

The housing-side opening edge portion 20 and the cover-side opening edge portion 34 form the electric wire lead-out opening 25. Because the electric wire 45 can be penetrated radially into the housing-side opening edge portion 20 and the cover-side opening edge portion 34, it is easy to perform the work of inserting the electric wire 45 into the electric wire lead-out opening 25.

The housing-side sealing member 50 and the cover-side sealing member 51 are pressed and deformed to waterproof the housing 11 during the installation of the cover 30 on the housing 11. Thus, it is unnecessary to install an annular rubber plug on an electric wire.

As described above, a prior art sealing member made of a gel or jelly-like material is provided for the housing or for the cover, and is pressed against one side of electric wires. However, the prior art sealing member may not spread to the other side of the electric wires. As a result, there is a possibility that the periphery of the electric wires is not completely watertight. According to the invention, on the other hand, the housing-side sealing member 50 and the cover-side sealing member 51 are pressed against the electric wire 45 from both sides and contact the wire 45 closely. Therefore, the periphery of the electric wire 45 at the electric wire lead-out opening 25 can be waterproofed securely.

A second embodiment of the present invention will be described below with reference to FIGS. 18 through 30. Elements of the second embodiment that are the same as those of the first embodiment are denoted by the reference numerals used in the first embodiment and a description of those elements is omitted herein.

In the first embodiment, the housing-side sealing member 50 and the cover-side sealing member 51 both are made of the gel or jelly-like material and are used as the waterproof means. In the second embodiment, a one-piece sealing member 70 made of an elastic material, such as rubber is used.

The sealing member 70 has an annular sealing portion 71 for sealing the gap between a housing-side confronting portion 82 and a cover-side confronting portion 86. The lower side of the sealing portion 71 is wider than the other sides thereof and closely contacts the peripheries of the electric wires 45. Thus the lower side of the sealing portion 71 serves as an electric wire-sealing portion 72 for sealing the periphery of an electric wire lead-out opening 89. A plurality of cylindrical portions 73 are formed on the electric wire-sealing portion 72 and contact the peripheries of the electric wire 45. A nick 76 is formed radially on the edge of the opening of each cylindrical portion 73, and the electric wire 45 can be inserted into the cylindrical portion 73 through the nick 76. A pair of guide projections 75 are formed at the side edges of the nick 76 and diverge outwardly in a natural state. The guide projections 75 guide the electric wire 45 into the cylindrical portion 73 of the nick 76. A concavity 77 is formed between the adjacent guide projections 75. Both guide projections 75 close to block the cylindrical portion 73 when a press-in piece 87 of the cover 87 is pressed into the concavity 77.

The connector 80 of this embodiment includes a housing 81. The housing 81 has a housing-side confronting portion 82, and an annular concavity 83 is formed on the inner side of the housing-side confronting portion 82. The sealing member 70 can be fitted in the concavity 83. A concave housing-side opening edge portion 84 is formed on the bottom surface of the housing-side confronting portion 82. The above referenced press-in piece 87, which corresponds to the concavity 77 of the sealing member 70, is formed on the lower side of the cover-side confronting portion 86. A concave cover-side opening edge portion 88 is formed between the adjacent press-in pieces 87. The electric wire lead-out opening 89 is formed between the housing-side opening edge portion 84 and the cover-side opening edge portion 88 when the cover 85 is mounted on the housing 81.

The connector 80 is assembled initially by installing the sealing member 70 on the concavity 83 of the housing 81. The one-piece construction enables the sealing member 70 to be installed easily on the concavity 83. The female-side terminal fixture 40 then is inserted into each cavity 13. Next, the rubber plug 65 is installed in a front to rear direction over the periphery of the projecting portion 14 at the front side of the housing 81. The retainer 67 then is installed in a front to rear direction over the projecting portion 14 to prevent the removal of the female-side terminal fixture 40 from the cavity 13.

Figure 26:
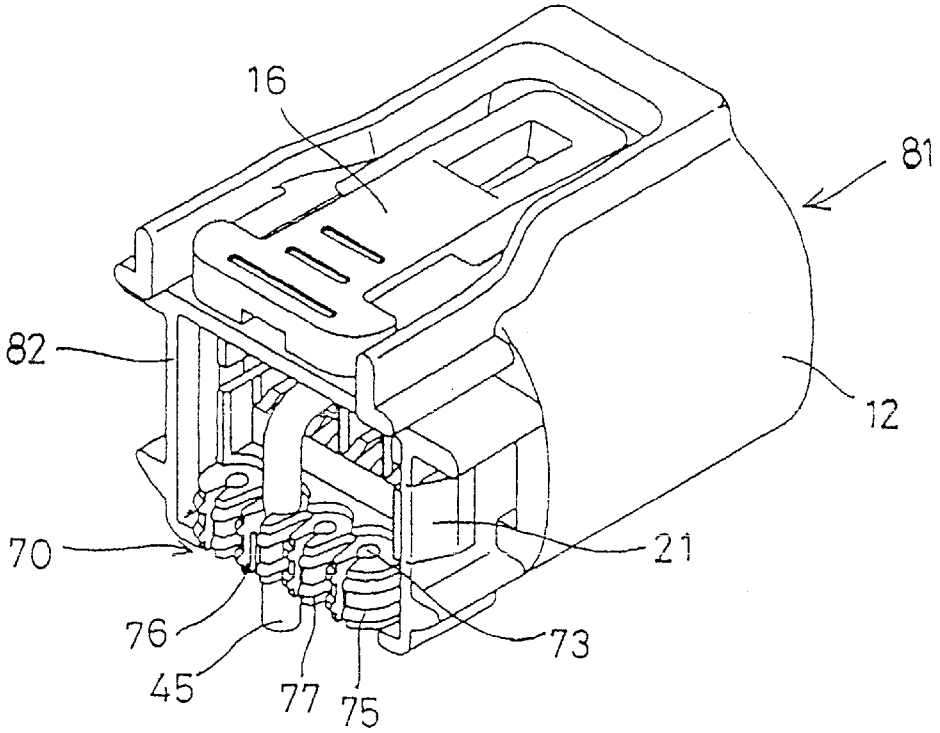
FIG. 26 is a rear view showing the process of installing parts on the housing.
Figure 27:
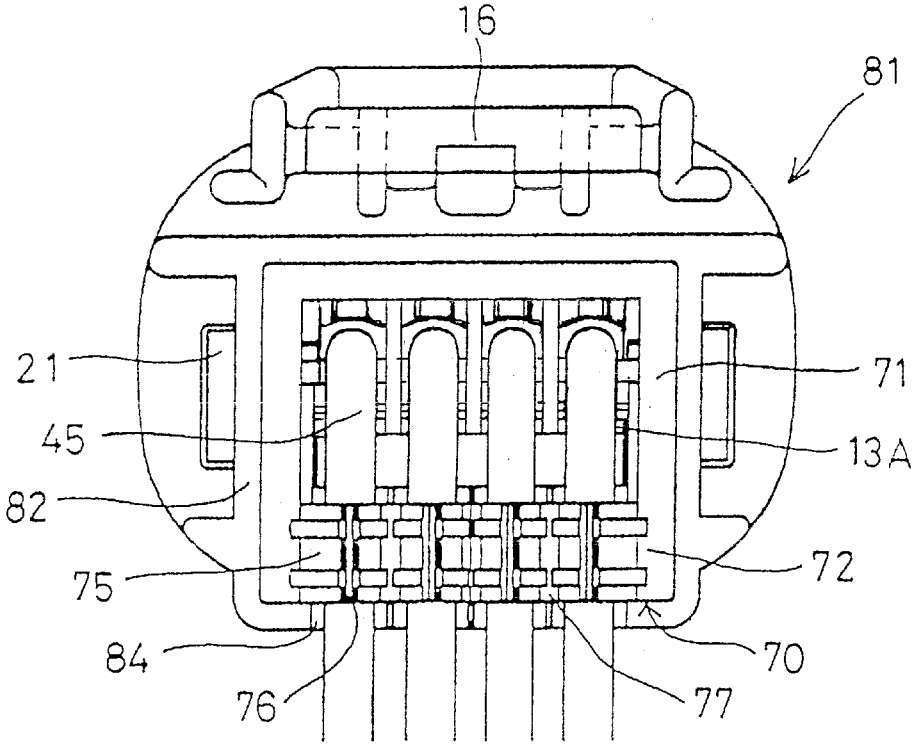
FIG. 27 is a rear view showing the process of installing parts on the housing.

The electric wire 45 that had been drawn out to a position rearwardly of the cavity 13 then is bent downwardly, and is pressed radially into the cylindrical portion 73 through the nick 76, as shown in FIGS. 26 and 27. At this time, both guide projection portions 75 contact the electric wire 45 and expand elastically to allow smooth insertion of the electric wire 45 into the cylindrical portion 73.

Figure 28:
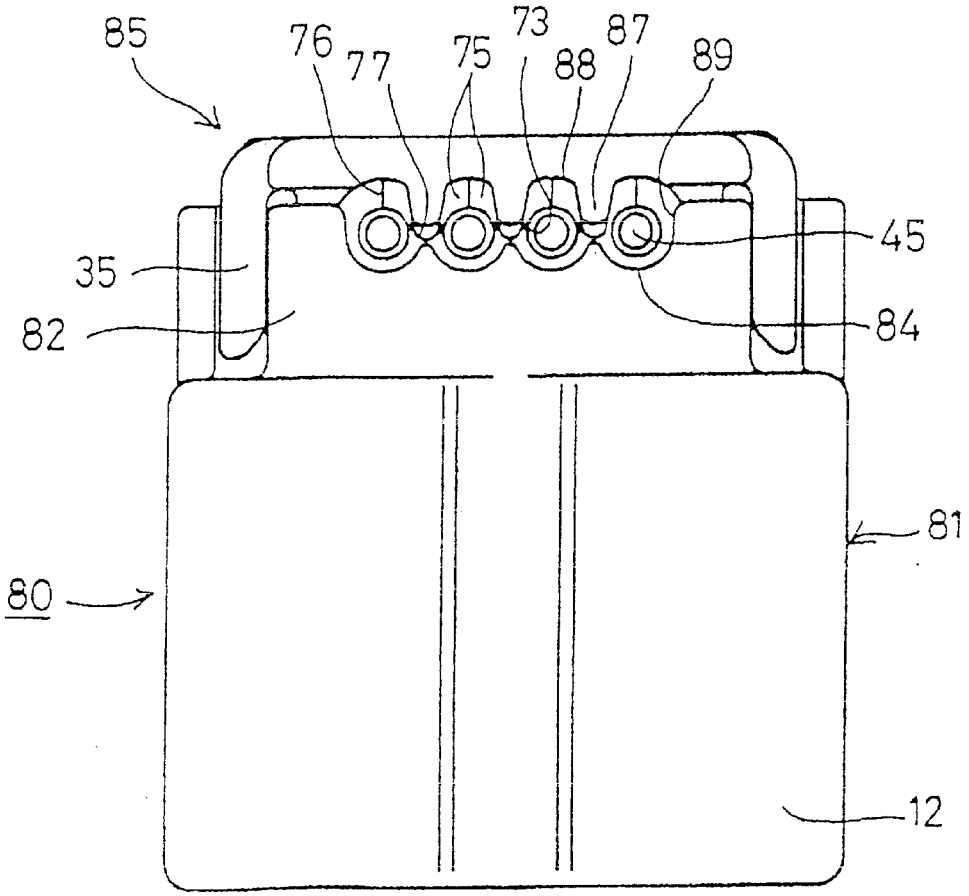
FIG. 28 is a bottom view showing an assembled connector.
Figure 29:
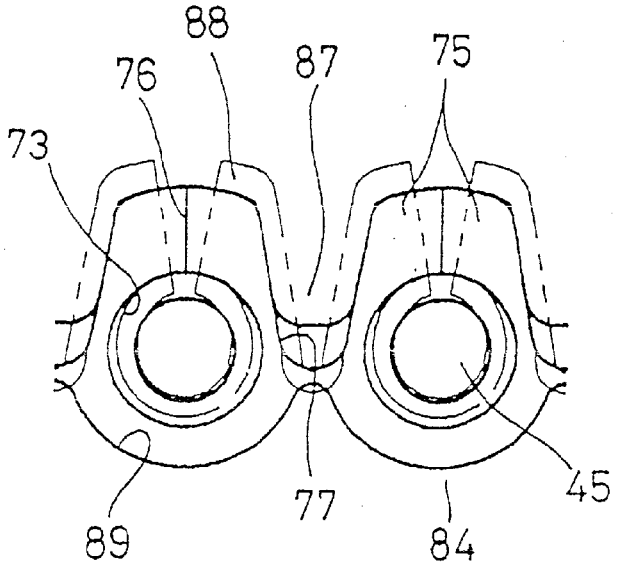
FIG. 29 is an enlarged bottom view showing an electric wire lead-out opening.
Figure 30:
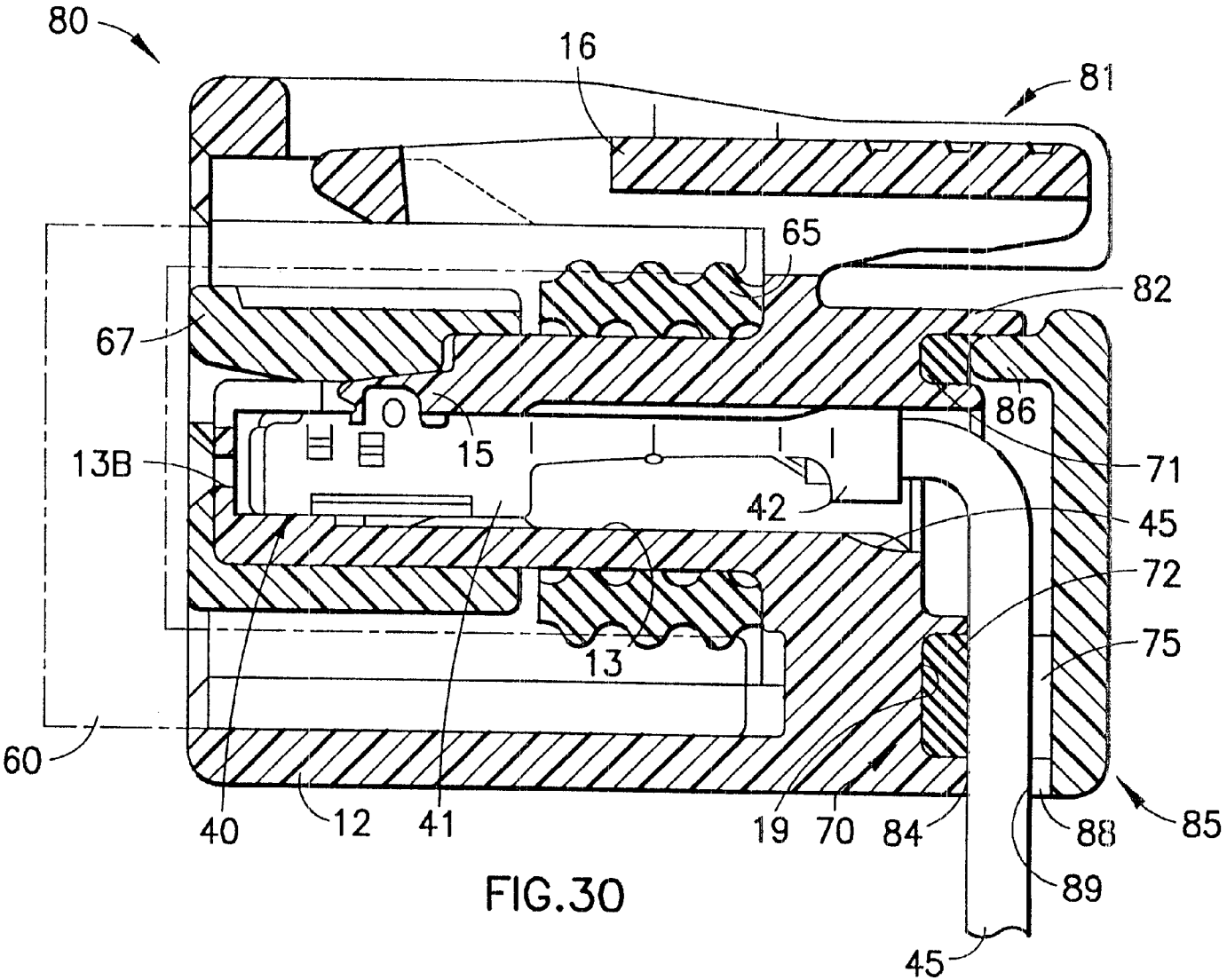
FIG. 30 is a sectional side view showing the assembled connector.

Assembly of the connector 80 proceeds by pressing the cover 85 against the housing 81. At this time, the sealing portion 71 is sandwiched elastically between both confronting portions 82 and 84, thus sealing the gap therebetween. At this time, the press-in piece 87 is pressed against the concavity 77 and both guide projections 75 are pressed and closed. As a result, the cylindrical portion 73 contacts the periphery of the electric wire 45 closely, as shown in FIGS. 28 through 30. The locking projections 21 are fitted in the locking holes 36 when the cover 85 is pressed to the predetermined position. In this manner, the assembling operation is completed.

As described above, the electric wires 45 are inserted radially into the cylindrical portions 73 through the nicks 76. Therefore, the electric wires 45 can be installed on the electric wire-sealing portion 72 smoothly. Further, because the press-in piece 87 presses the guide projection portions 75 in the closing direction, the peripheries of the electric wires 45 can be waterproofed securely.

FIGS. 31 through 43 show a third embodiment of the present invention. The third embodiment includes a sealing member 118, which, as in the second embodiment, is formed from an elastic material, such as a rubber material. However the sealing member 118 of the third embodiment is divided into two parts. Elements of the third embodiment that differ from the second embodiment will be described below. Elements with the same function as those of the first and second embodiments are denoted by the reference numerals of the first and second embodiments. Thus, a description of those elements is omitted herein.

Figure 31:
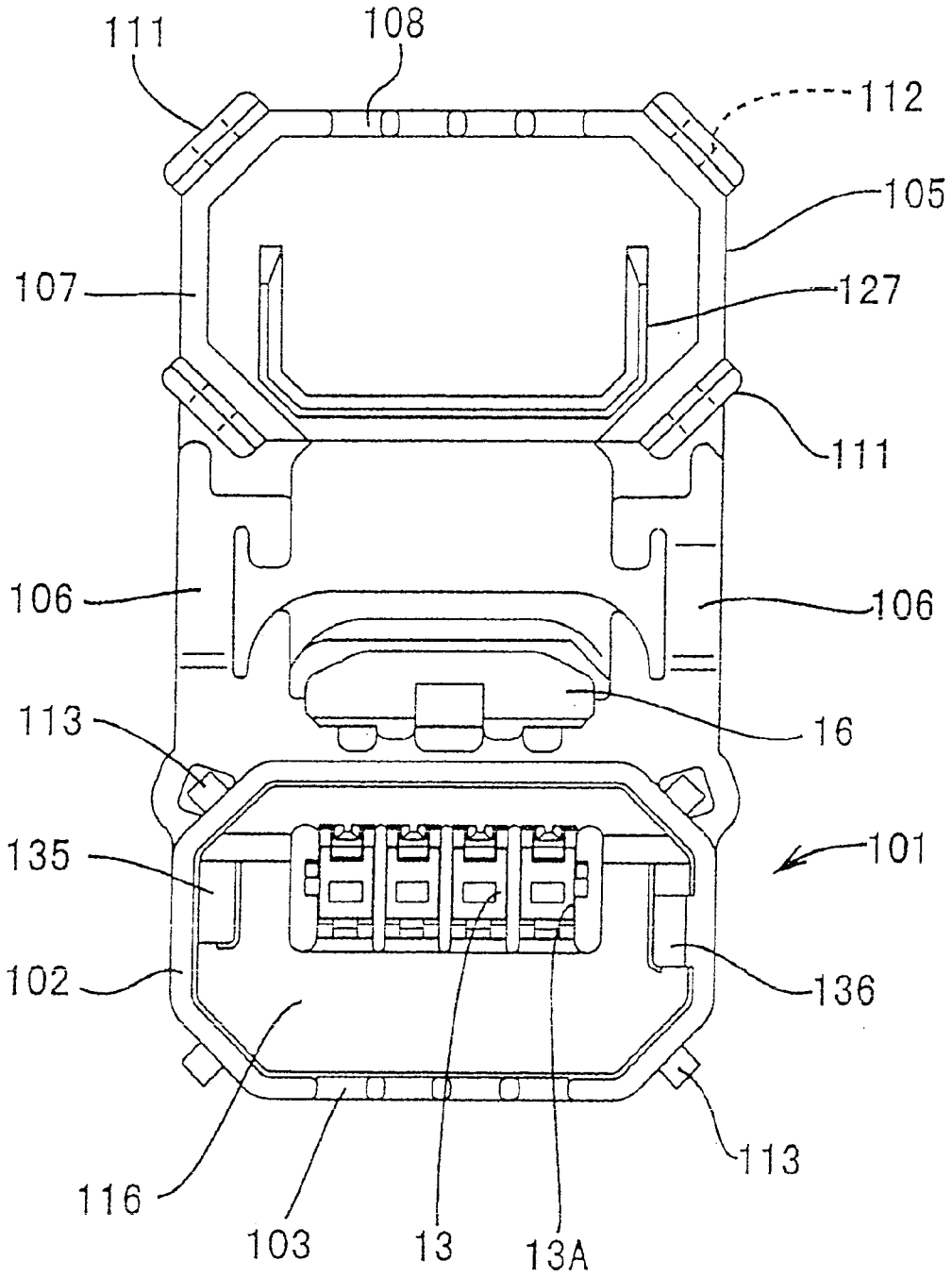
FIG. 31 is a rear view showing a housing of a third embodiment.
Figure 32:
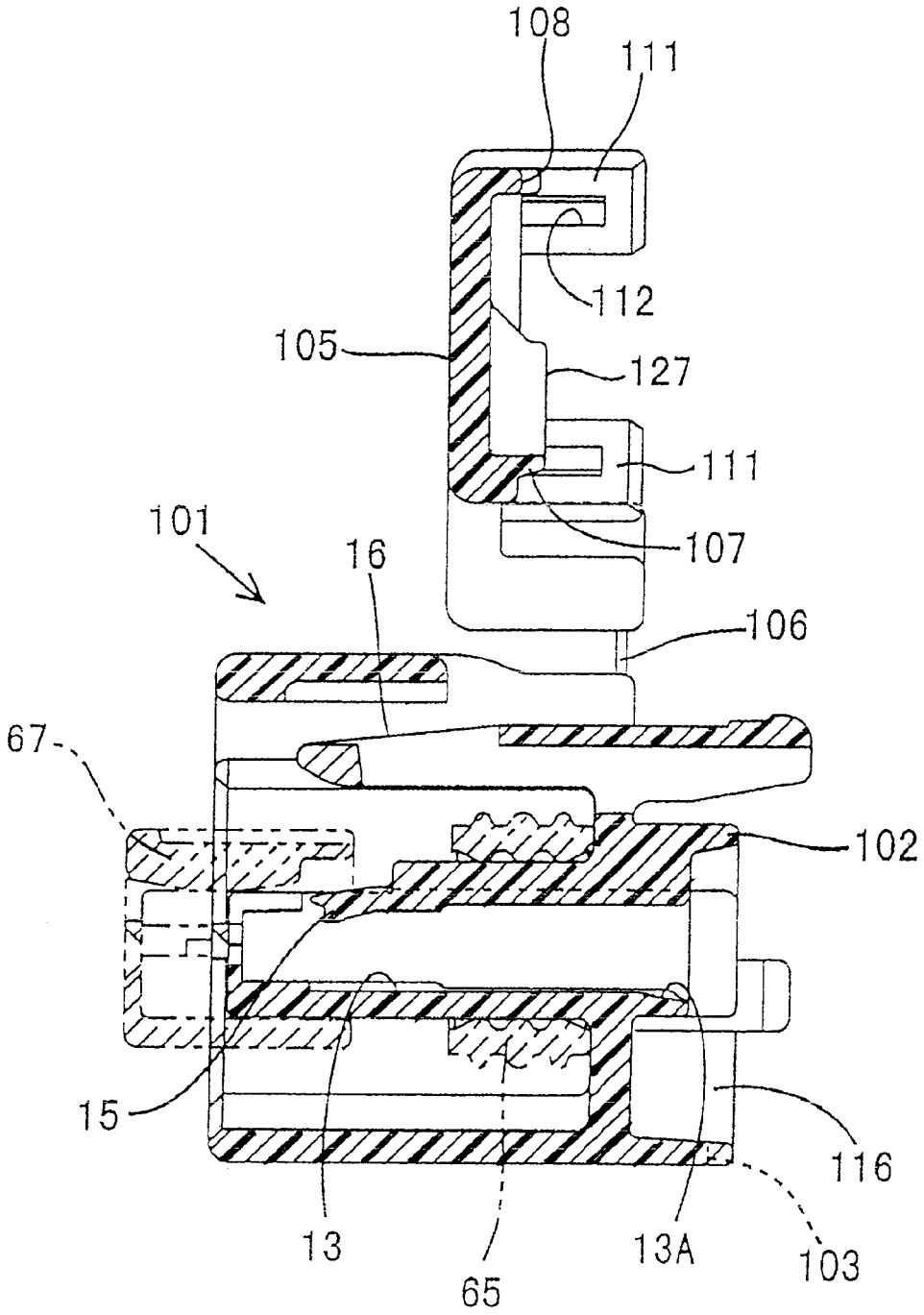
FIG. 32 is a sectional side view showing the housing.
Figure 33:
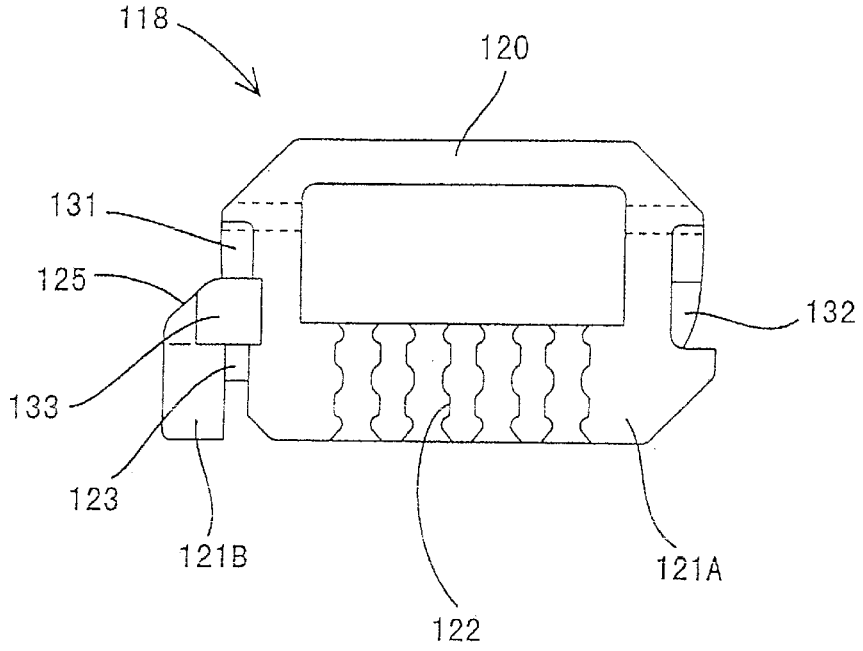
FIG. 33 is a front view showing a molding state of a sealing member.

Referring to FIGS. 31 and 32, terminal insertion openings 13A of four respective cavities 13 are arranged widthwise on a rear end surface of a housing 101. A square pillar-shaped housing-side projecting wall 102 with truncated corners is formed on the periphery of the terminal insertion openings 13A. A plurality of housing-side opening edge portions 103 are formed at equal intervals along the lower-side wall of the housing-side projecting wall 102, and are dimensioned to receive one of the electric wires 45.

The rear end surface of the housing 101 can be covered with a cover 105. The cover 105 is molded unitarily with a hinge 106, which in turn extends unitarily from an upper surface of a rear portion of the housing 101. The posture of the cover 105 is reversed during molding to the posture it has when it covers the housing 101. A cover-side projecting wall 107 is formed on the peripheral edge of the rear surface of the cover 105. By downwardly reversing the cover 105 on the hinge 106, the rear end surface of the housing 101 can be covered with the cover-side projecting wall 107 in contact with the housing-side projecting wall 102. A plurality of cover-side opening edge portions 108 are formed on a lower side (upper side in mold time) of the cover-side projecting wall 107 at locations that can register with the housing-side opening edge portions 103. Thus electric wire lead-out openings 110 are formed by both opening edge portions 103 and 108.

Elastic locking pieces 111 with locking grooves 112 formed thereon project from each of the four corners of the cover 105, and are oriented such that the elastic locking pieces 111 face the rear surface of the cover 105. Locking projections 113 with tapered surface 114 are formed on the four C-shaped surfaces of the housing-side projecting wall 102. Thus the tapered surfaces 114 can be fitted in the respective locking grooves 112.

Accordingly, when the cover 105 is pivoted downwardly 180° on the hinge 106 from the molding position of FIG. 32, the corresponding locking projections 113 are fitted elastically in the locking grooves 112 of the respective elastic locking pieces 111. As a result, the housing-covering posture of the cover 105 is maintained.

An installing concavity 116 is provided for receiving the sealing member 118. The installing concavity 116 is formed on the rear end surface of the housing 101 at locations inwardly adjacent to the housing-side projecting wall 102 and surrounding the terminal insertion openings 13A of the cavities 13. Upper parts of the installing concavity 116 are shallow where the terminal insertion openings 13 A are formed, whereas other parts of the installing concavity 116 are deep.

Figure 35:
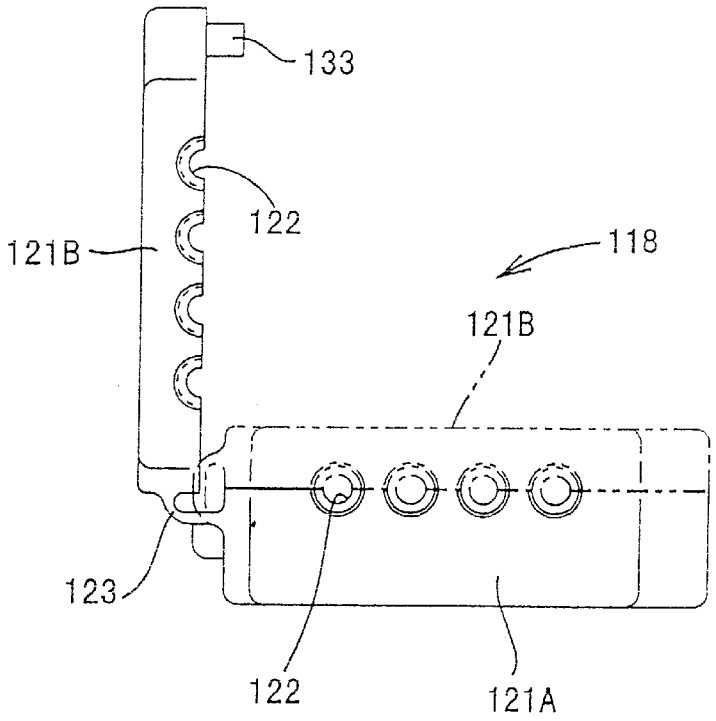
FIG. 35 is a bottom view showing the sealing member.
Figure 36:
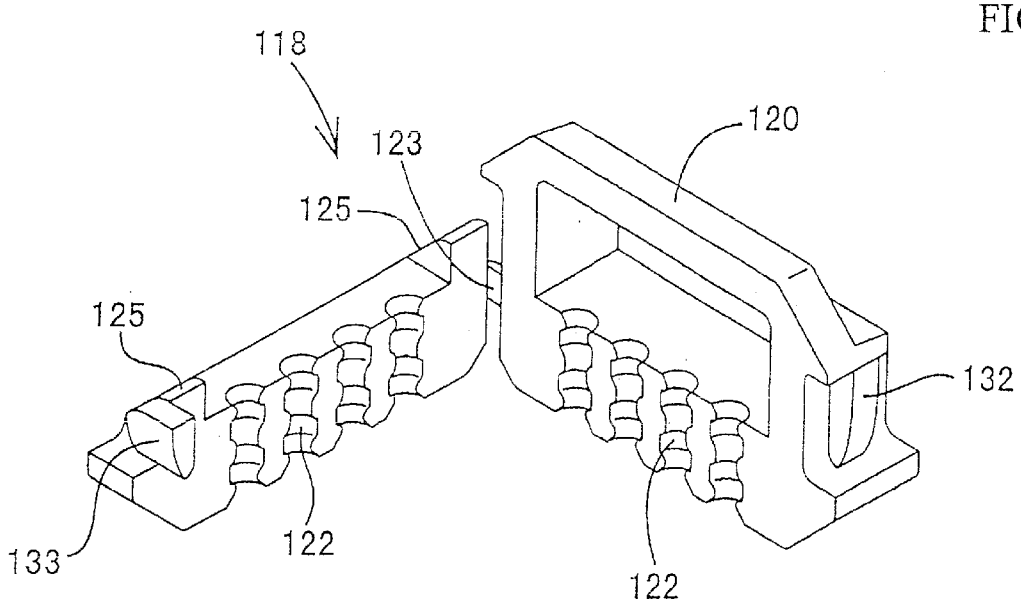
FIG. 36 is a perspective view showing the sealing member.
Figure 37:
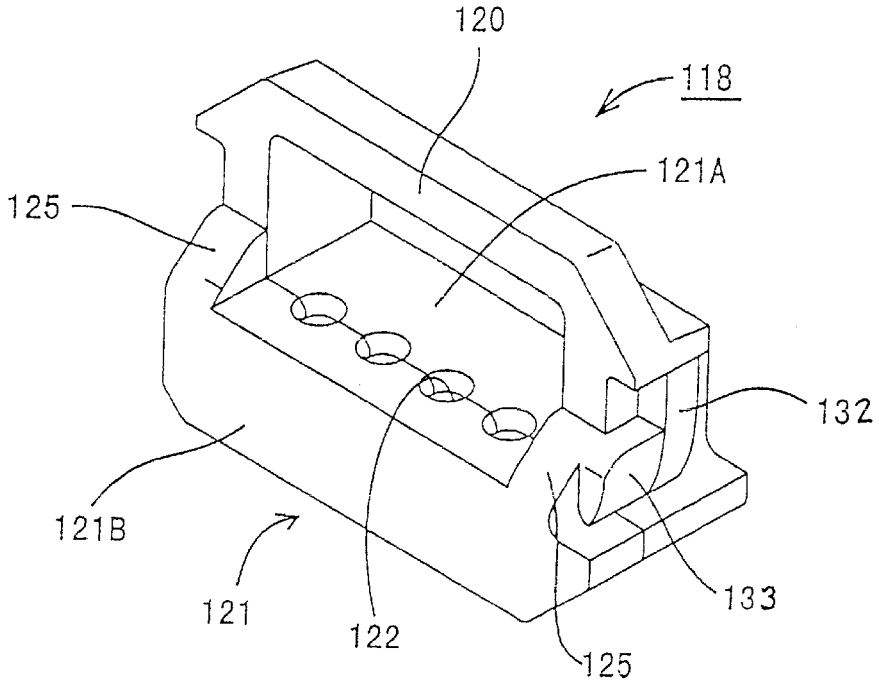
FIG. 37 is a perspective view showing a sealing member-assembled state.
Figure 38:
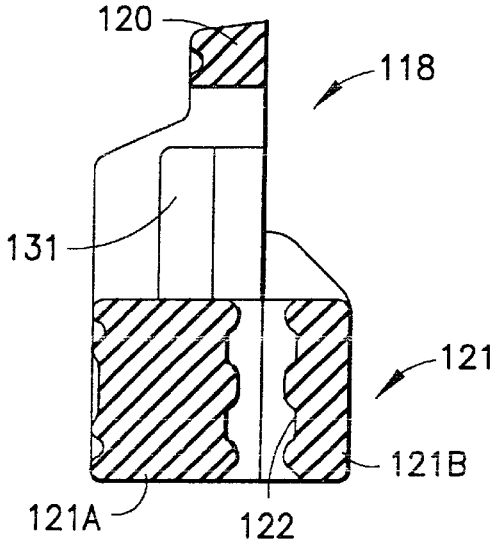
FIG. 38 is a partly cut-out side view showing the sealing member.

The configuration of the sealing member 118 is shown in FIGS. 33 through 38. With reference to FIG. 37, the entire sealing member 118 has a sealing portion 120 which is annular in a front view and which matches the installing concave portion 116 of the housing 101. As shown in FIG. 38, the upper side of the sealing portion 120 is thin, whereas the right and left side portions are thick and project forwardly, as shown on the left side in FIG. 38. The bottom of the sealing portion 120 is tall and projects forwardly and rearwardly and at both sides. The bottom portion of the sealing portion 120 serves as an electric wire-sealing portion 121. The electric wire-sealing portion 121 contacts the periphery of the electric wire 45 and seals the periphery of the electric wire lead-out opening 110.

Four vertical insertion holes 122 are formed on the electric wire-sealing portion 121 along positions corresponding to the rear surface of the sealing portion 120. The insertion holes 122 are dimensioned for waterproof reception of the electric wires 45.

The electric wire-sealing portion 121 is divided into a stationary-side electric wire-sealing portion 121A and a movable-side electric wire-sealing portion 121B along a surface crossing the insertion holes 122. The stationary-side electric wire-sealing portion 121A and the movable-side electric wire-sealing portion 121B are connected with each other through a hinge 123 at one-end side of a widthwise direction. In a molding time, the stationary-side electric wire-sealing portion 121A is perpendicular to the movable-side electric wire-sealing portion 121B, as shown in FIGS. 33 through 36.

Figure 34:
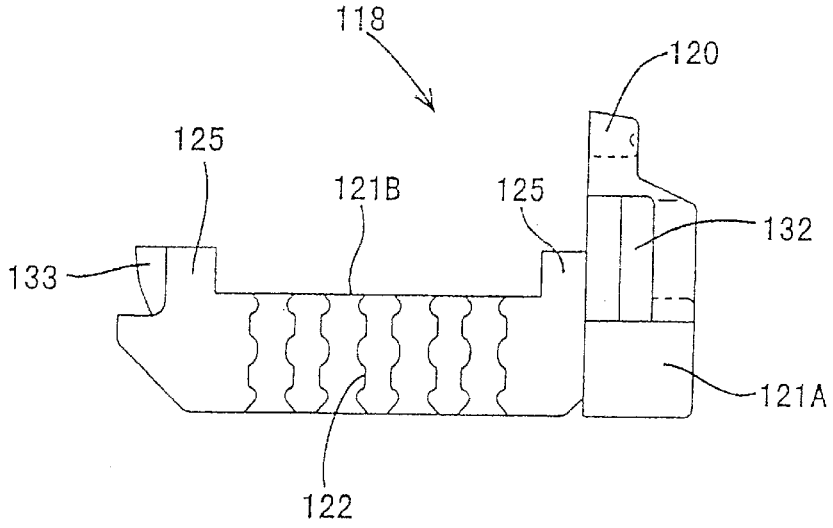
FIG. 34 is a side view showing the sealing member.

An up-grade wall 125 is formed at both ends of the upper surface of the movable-side electric wire-sealing portion 121B. As shown in FIG. 34, when the movable-side electric wire-sealing portion 121B is closed, the up-grade wall 125 contacts the lower end of the rear surface of the right and left side portions of the sealing portion 120.

As shown in FIG. 31, a gate-shaped rib 127 that is formed on the rear surface of the cover 105 is located at the upper side when the housing 101 is covered with the cover 105. When the housing 101 is covered with the cover 105, the rib 127 is capable of pressing the upper, right, and left portions of the sealing portion 120 of the sealing member 118 and the up-grade wall 125 of the movable-side electric wire-sealing portion 121B.

Figure 43:
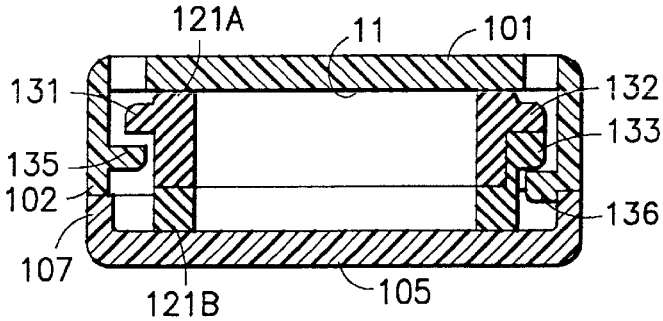
FIG. 43 is a sectional plan view showing a temporary holding construction of the sealing member.
Figure 44:
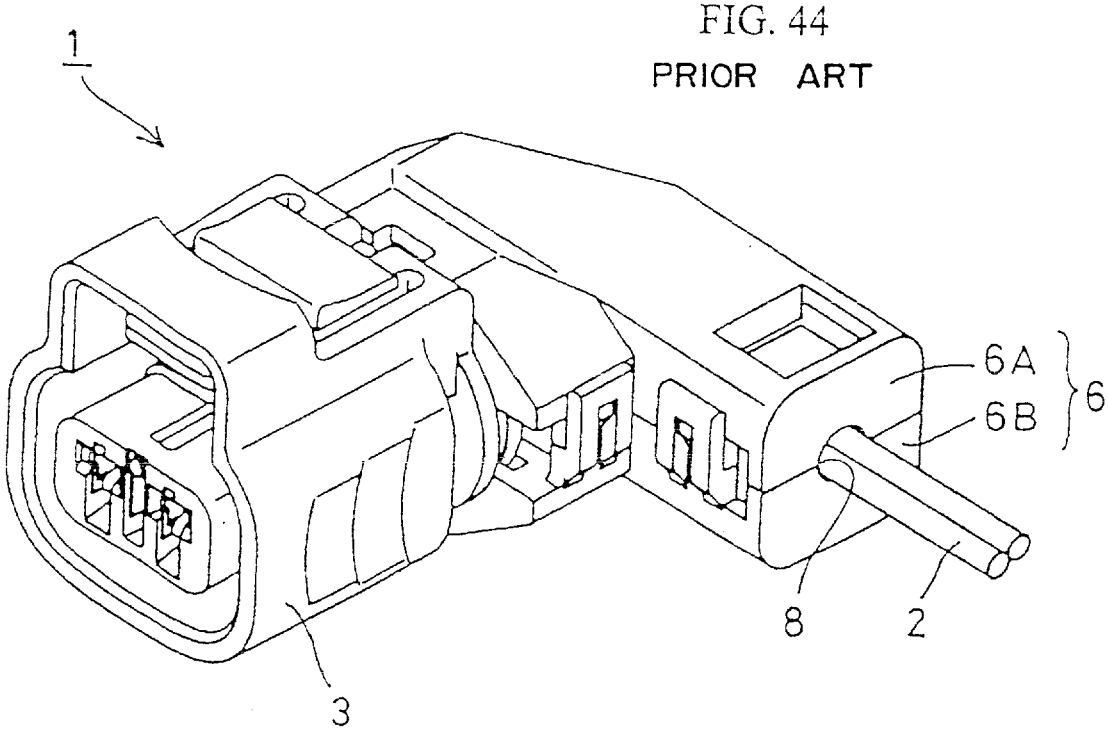
FIG. 44 PRIOR ART
FIG. 44 is a perspective view showing a conventional connector.
Figure 45:
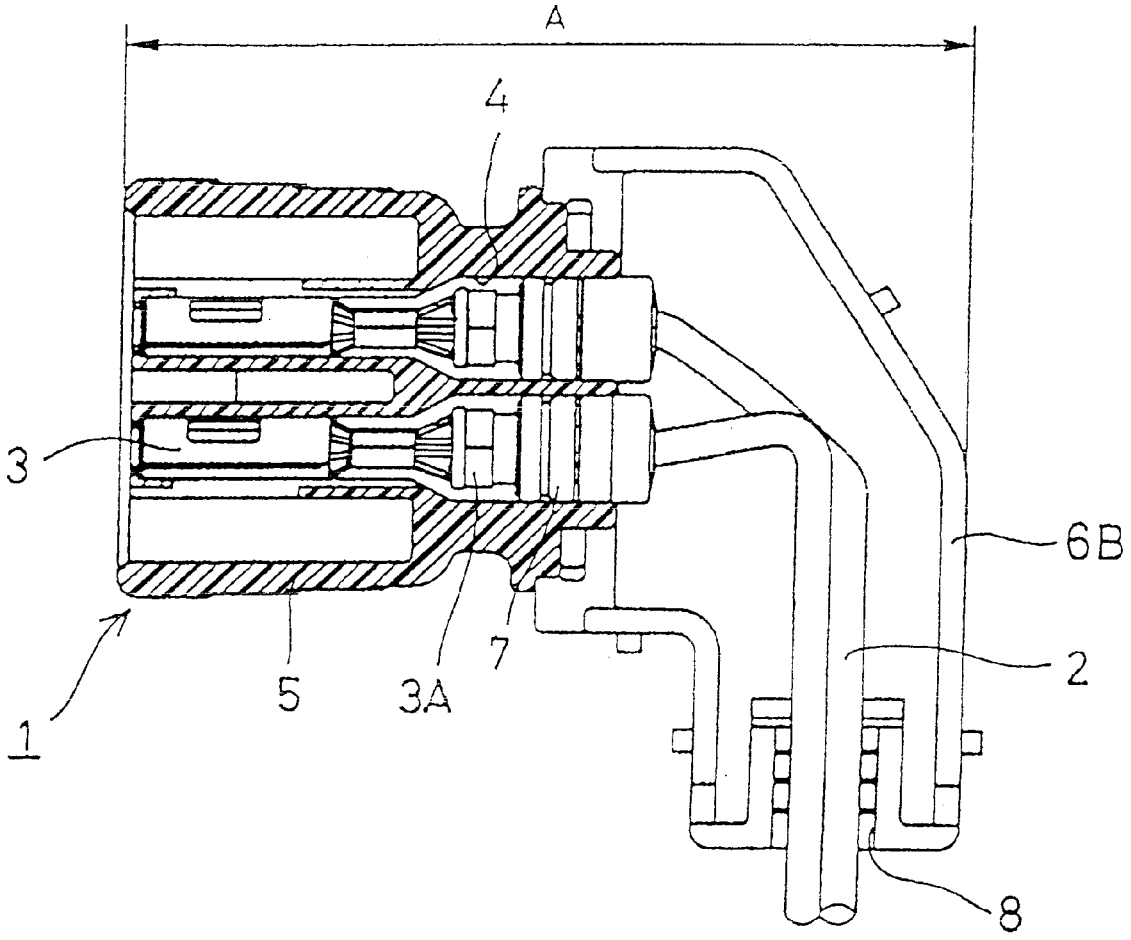
FIG. 45 PRIOR ART
FIG. 45 is a sectional plan view showing the conventional connector.

A first to-be-locked portion 131 and a second to-be-locked portion 132 project from the outer surface of the right and left side portions of the sealing portion 120 of the sealing member 118, such that the first to-be-locked portion 131 and the second to-be-locked portion 132 are located approximately at the center in a depth direction of the sealing portion 120. A short third to-be-locked portion 133 is formed on the outer surface of the up-grade wall 125 of the movable-side electric wire-sealing portion 121B at a free end side thereof. When the movable-side electric wire-sealing portion 121B is closed, the third to-be-locked portion 133 is superimposed on the lower side of the rear surface of the second to-be-locked portion 132. As shown in FIG. 43, a first locking piece 135 projects inwardly from the left inner wall of the housing-side projecting wall 102 at a location slightly inwardly from the front edge of the housing-side projecting wall 102. The first locking piece 135 is capable of locking the first to-be-locked portion 131 of the sealing member 118 thereto. A second locking piece 136 projects inwardly from the right inner wall of the housing-side projecting wall 102 substantially at the front edge of the housing-side projecting wall 102. The second locking piece 136 is capable of locking the third to-be-locked portion 133 of the sealing member 118 thereto.

The third embodiment is assembled by fitting the sealing member 118, whose movable-side electric wire-sealing portion 121B is open as shown in FIG. 36, into the installing concavity 116 on the rear surface of the housing 101. At this time, as shown in FIG. 43, the first to-be-locked portion 131 of the sealing member 118 is locked to the rear side of the first locking piece 135. The second to-be-locked portion 132 of the sealing member 118 is located at the rear side of the second locking piece 136, but there is still a clearance left between the second to-be-locked portion 132 and the second locking piece 136.

Thereafter, the female-side terminal fixture 40 fixed to one end of the electric wire 45 is inserted into the corresponding cavity 13 form the terminal insertion opening 13A, and the retainer 67 is pressed into the normal locking position for double locking. Each electric wire 45 then is drawn out from the cavity 13, and is bent downwardly. Each electric wire then is inserted into the insertion hole 122 of the stationary-side electric wire-sealing portion 121 A and into the housing-side opening edge portion 103.

Assembly continues by pivoting the open movable-side electric wire-sealing portion 121B about the hinge 106 and toward the stationary-side electric wire-sealing portion 121A, such that the sealing portions 121A and 121B contact each other, as shown by the chain line of FIG. 35. At this time, the third to-be-locked portion 133 at the free end side is situated at the rear side of the a second locking piece 136 of the housing 101. As a result, as shown in FIG. 43, the second to-be-locked portion 132 and the third to-be-locked portion 133 are superimposed on each other, and are locked to the second locking piece 136. In this manner, the sealing member 118 is held temporarily inside the installing concavity 116, the electric wire-sealing portions 121A and 121B are kept in a closed state, and each electric wire 45 is in the insertion hole 122 of each of the electric wire-sealing portions 121A and 121B .

Figure 40:
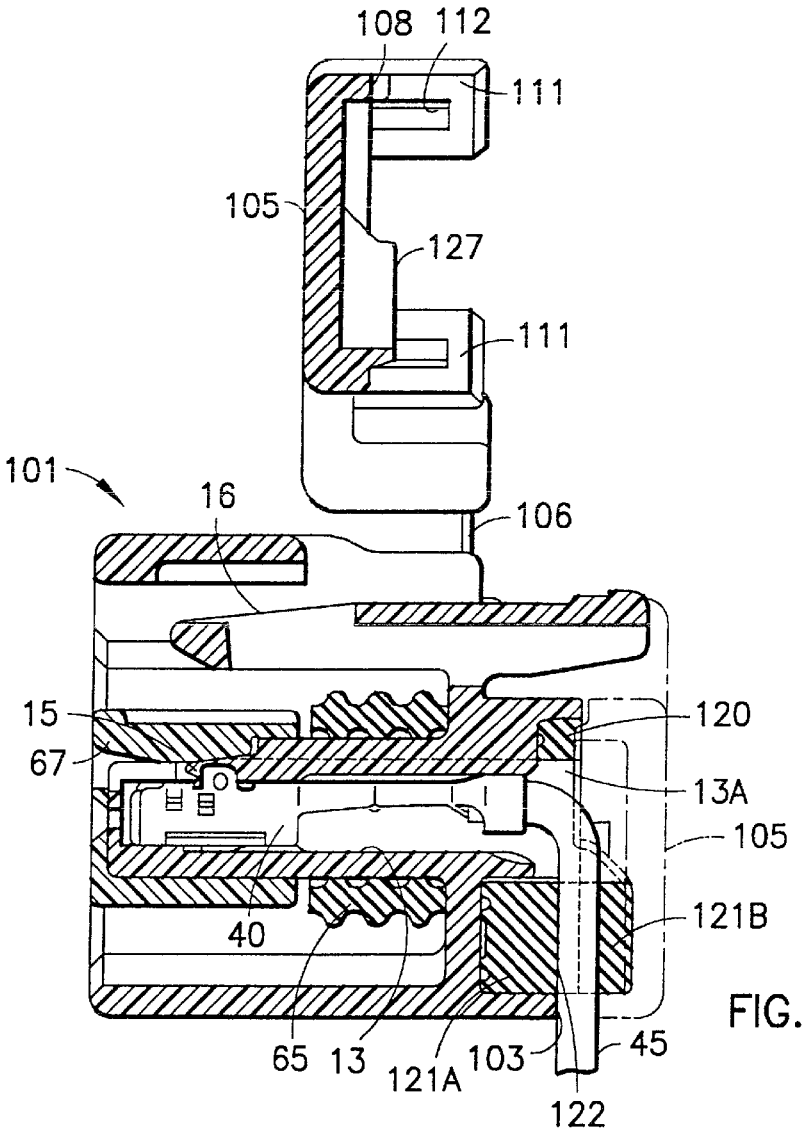
FIG. 40 is a sectional side view showing the connector.
Figure 39:
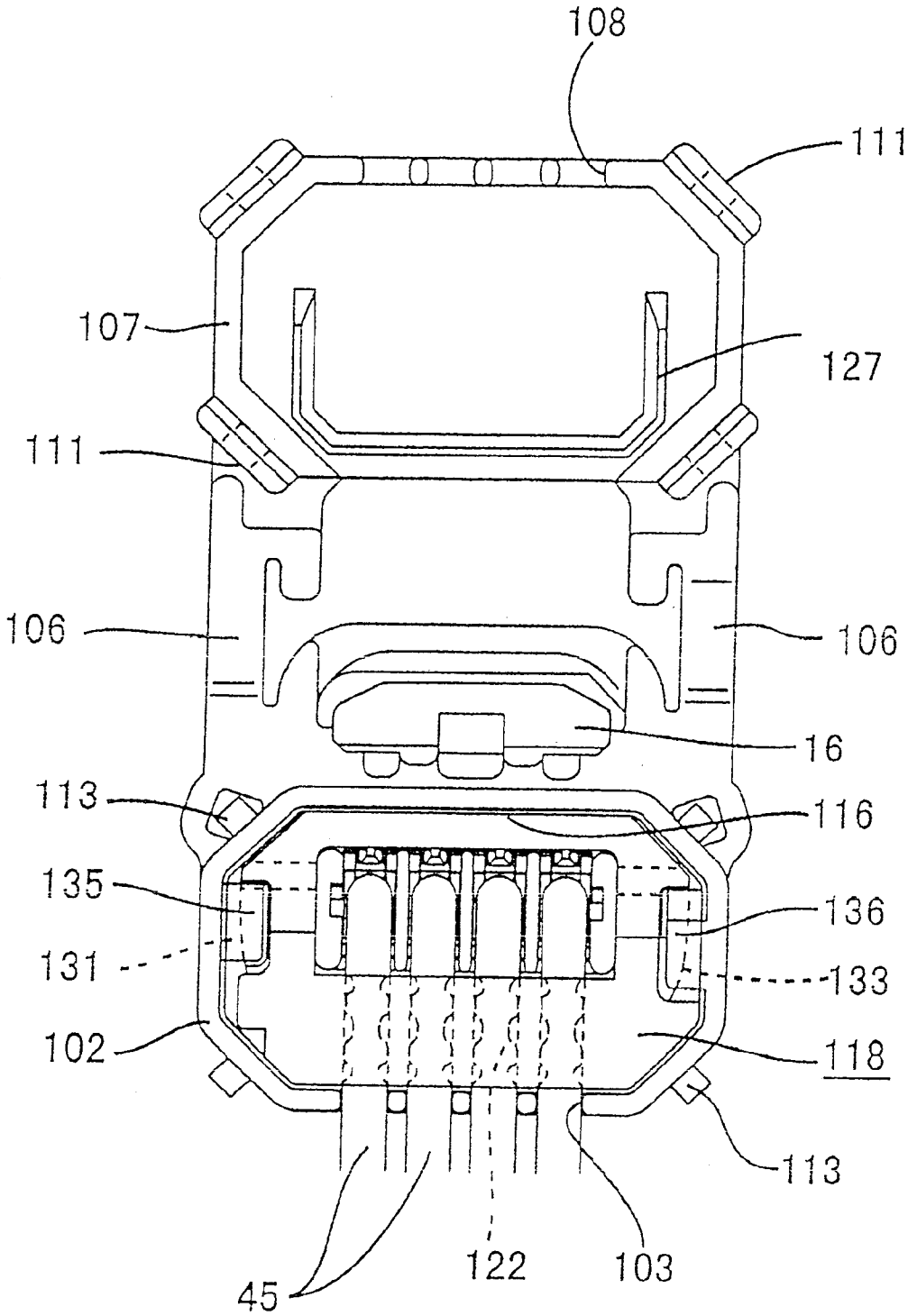
FIG. 39 is a rear view showing a connector on which the sealing member is installed.
Figure 41:
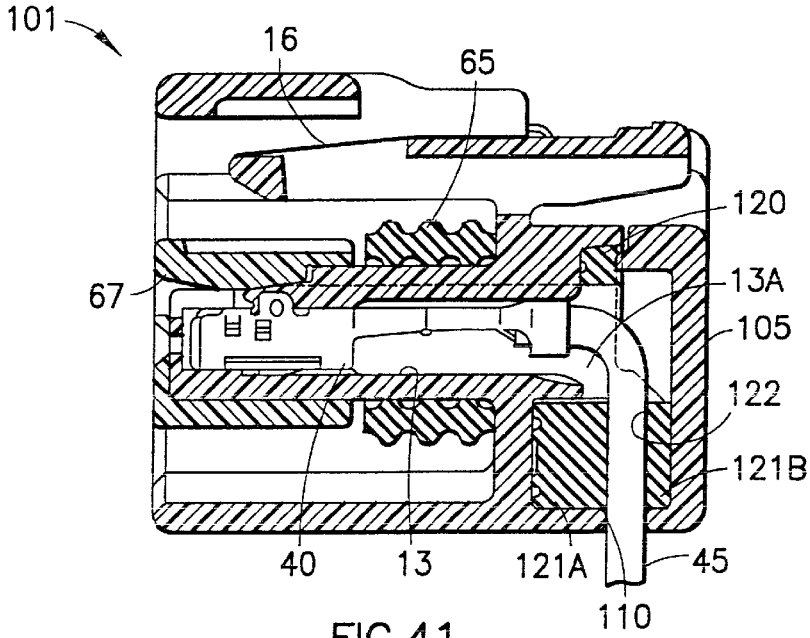
FIG. 41 is a sectional side view showing the housing on which a cover is installed.

The assembly proceeds by pivoting the cover 105 downwardly on the hinge 106, as shown with a chain line of FIG. 40. This pivotal motion causes the front ends of the elastic locking pieces 111 to ride on the respective tapered surfaces 114 and the locking projections 113 elastically deform. The cover 105 is pivoted until the cover-side projecting wall 107 contacts the housing-side projecting wall 102. The locking projections 113 then fit in the respective locking grooves 112, and the elastic locking pieces 111 restore to their original state. As a result, the cover 105 is locked. Each electric wire 45 is drawn out from the electric wire lead-out opening 110 formed by both opening edge portions 103 and 108 (see FIG. 41).

Figure 42:
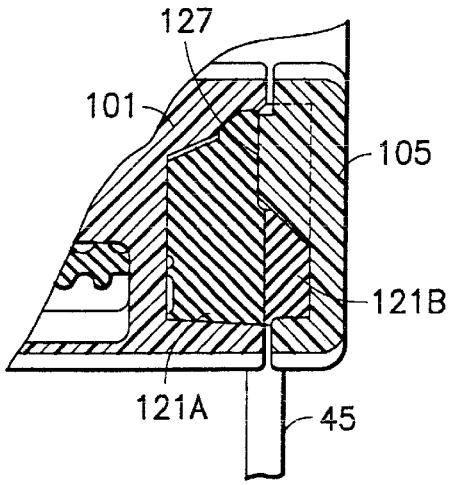
FIG. 42 is partial sectional view showing the construction of a pressing portion of a rib.

Consequently, as shown in FIG. 42, the rib 127 formed on the rear surface of the cover 105 presses the upper, right, and left portions of the sealing portion 120 of the sealing member 118 and the up-grade wall 125 of the movable-side electric wire-sealing portion 121B. At this time, the rear surface of the cover 105 presses the rear surface of the movable-side electric wire-sealing portion 121B. As a result, the periphery of the terminal insertion opening 13A of the cavity 13 is sealed with the sealing portion 120, and the inner peripheral surface of the insertion hole 122 of the electric wire-sealing portions 121A and 121B contacts the entire periphery of the electric wire 45. In this manner, the entire periphery of the electric wire 45 is sealed favorably.

As described above, in the third embodiment, the electric wire-sealing portion 121 of the sealing member 118 can be opened and closed. Thus, with the electric wire-sealing portion 121 kept in an open state, the sealing member 118 is installed on the installing concavity 116, and the female-side terminal fixture 40 is installed on the cavity 13. Then, the movable-side electric wire-sealing portion 121B is closed. Therefore, the third embodiment has a high degree of workability.

Further, the electric wire-sealing portions 121A and 121B of the sealing member 118 are connected with each other through the hinge 106 and can be handled as one sealing member 118. Thus, it is easy to handle the sealing member 118.

The electric wire-sealing portions 121A and 121B can be closed firmly by means of the rib 127 formed on the rear surface of the cover 105. Thus, a high degree of sealing performance can be obtained on the periphery of the electric wire 45.

The sealing member 118 is temporarily held in the installing concavity 116, with the electric wire-sealing portions 121A and 121B kept in a closed state. Therefore, an operator can pivot the cover 105 onto the housing 101 without caring about the sealing member 118.

The present invention is not limited to the embodiment described. For example, embodiments described below are included in the technical scope of the present invention. Further, various changes and modifications can be made unless they do not depart from the gist of the present invention.

In the third embodiment, the divided electric wire-sealing portion formed separately is also included in the technical scope of the present invention.

In the third embodiment, the housing and the cover may be separately formed.

Although in each embodiment, the connector of the embodiment is a female-side connector for accommodating the female-side terminal fixture, it may be applicable to a male-side connector for accommodating a male-side terminal fixture.

What is claimed is:

1. A connector comprising:

a terminal fixture having a first end that is connectable with a mating terminal fixture and a second end that is connected with an end of an electric wire;

a housing with opposite front and rear sides, at least one cavity extending through said housing from said front side to said rear side, said cavity being dimensioned and configured for accommodating said terminal fixture therein, said rear side of said housing being configured to define at least one electric wire draw-out portion disposed and dimensioned for accommodating a portion of said wire by bending said wire at location rearwardly of said cavity, such that said electric wire draw-out portion leads said electric wire to a location externally of said housing;

a cover installed on said housing such that said cover covers the electric wire draw-out portion and portions of said electric wire accommodated therein; and a sealing member disposed between the cover and the rear side of the housing for sealing any gap between said cover and said housing and for sealing a periphery of said electric wire at said electric wire draw-out portion said sealing member has a cylindrical portion formed with a nick formed radially therein, said electric wire being received in said nick; a pair of guide projections formed at opposed side edge portions of said nick such that said guide projection portions expand outwardly and elastically to guide said electric wire into the cylindrical portion; said cover having a press-in piece that penetrates into an outer side of each of said guide projection portions to deform said guide projection portions in a closing direction when said cover is installed on said housing, whereby said periphery of said electric wire is sealed.

2. A connector according to claim 1, wherein said electric wire lead-out opening is formed by a housing-side opening edge portion on said housing and a cover-side opening edge portion on said cover; and said electric wire is capable of penetrating radially into an inner side of said housing-side opening edge portion and said cover-side opening edge portion.

3. A connector according to claim 2, wherein said sealing member is made of a rubber material and is dimensioned and configured to be pressed and deformed during installation of said cover on said housing for sealing said gap between said cover and said housing and for sealing said periphery of said electric wire at said electric wire lead-out opening.

4. A connector according to claim 2, wherein said sealing member is formed of an electric wire-sealing portion made of an elastic material and being configured for sealing a periphery of said electric wire lead-out opening, said electric wire-sealing portion being in close contact with said periphery of said electric wire and being formed of a sealing portion continuous with said electric wire-sealing portion and being configured for sealing a gap between a housing-side confronting portion of said housing and a cover-side confronting portion of said cover, with said sealing portion being entirely sandwiched between said housing-side confronting portion and said cover-side confronting portion.

5. An electrical connector comprising:

a housing with opposite front and rear sides, a plurality of interconnected walls extending forwardly from said rear side and defining a wire bending space at said rear side, a plurality of cavities extending from said front side to said wire bending space, one of said interconnected walls being formed with a plurality of concave wire receiving portions at said rear side of said housing and angularly aligned to said cavities;

a plurality of terminal fixtures being mounted in the respective cavities of said housing;

a wiring sealing member having a cylindrical portion formed with a nick extending radially therein, said wire being received in the nick, a pair of guide projections formed at opposed side edge portions of said nick such that said guide projection portions expand outwardly and elastically to guide said electric wire into the cylindrical portion;

a cover installed on said housing and covering said wire bending space and portions of said wires in said wire bending space, said cover having edge portions aligned respectively with said concave wire receiving portions of said housing, said cover having a press-in piece that penetrates into an outer side of each of said guide projection portions to deform said guide projection portions in a closing direction when said cover is installed in said housing, whereby said peripheries of said wires are sealed.

6. The connector of claim 5, wherein said wire is bent through substantially 90° in said wire bending space.

* * * * *